US007160421B2

(12) United States Patent
Wilson et al.

(10) Patent No.: US 7,160,421 B2
(45) **Date of Patent: *Jan. 9, 2007**

(54) TURNING ELECTRODES USED IN A REACTOR FOR ELECTROCHEMICALLY PROCESSING A MICROELECTRONIC WORKPIECE

(75) Inventors: Gregory J. Wilson, Kalispell, MT (US); Paul R. McHugh, Kalispell, MT (US); Robert A. Weaver, Kalispell, MT (US); Thomas L. Ritzdorf, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 734 days.

This patent is subject to a terminal disclaimer.

(21) Appl. No.: 09/866,463

(22) Filed: May 24, 2001

(65) Prior Publication Data

US 2002/0125141 A1 Sep. 12, 2002

Related U.S. Application Data

(63) Continuation-in-part of application No. 09/849,505, filed on May 4, 2001, and a continuation-in-part of application No. PCT/US00/10120, filed on Apr. 13, 2000.

(60) Provisional application No. 60/206,663, filed on May 24, 2000, provisional application No. 60/182,160, filed on Feb. 14, 2000, provisional application No. 60/143,769, filed on Jul. 12, 1999, provisional application No. 60/129,055, filed on Apr. 13, 1999.

(51) Int. Cl.

| | |
|---|---|
| ***C25D 17/00*** | (2006.01) |
| ***C25D 17/12*** | (2006.01) |
| *C25D 7/12* | (2006.01) |
| *C25D 5/16* | (2006.01) |

(52) U.S. Cl. ..... 204/229.4; 204/269; 204/272; 204/237; 204/DIG. 7; 204/212; 204/224 R; 205/82; 205/96; 205/292

(58) Field of Classification Search ..... 204/230.2, 204/230.7, 269, 224 R, 229.4, DIG. 7, 272, 204/237, 212

See application file for complete search history.

(56) References Cited

U.S. PATENT DOCUMENTS 1,526,644 A 2/1925 Pinney (Continued)

FOREIGN PATENT DOCUMENTS

CA 873651 6/1971

(Continued)

OTHER PUBLICATIONS

Singer, Peter, :Nonuniformity of Copper Electroplating Studied from Semiconductor International, Jun. 1998.*

(Continued)

*Primary Examiner*—Harry D. Wilkins, III
(74) *Attorney, Agent, or Firm*—Perkins Coie LLP

(57) ABSTRACT

A facility for selecting and refining electrical parameters for processing a microelectronic workpiece in a processing chamber is described. The facility initially configures the electrical parameters in accordance with either a mathematical model of the processing chamber or experimental data derived from operating the actual processing chamber. After a workpiece is processed with the initial parameter configuration, the results are measured and a sensitivity matrix based upon the mathematical model of the processing chamber is used to select new parameters that correct for any deficiencies measured in the processing of the first workpiece. These parameters are then used in processing a second workpiece, which may be similarly measured, and the results used to further refine the parameters.

32 Claims, 14 Drawing Sheets

U.S. PATENT DOCUMENTS

| | | | | |
|---|---|---|---|---|
| 1,881,713 | A | | 10/1932 | Laukel |
| 2,256,274 | A | | 9/1941 | Boedecker et al. |
| 3,616,284 | A | | 10/1971 | Bodmer et al. |
| 3,664,933 | A | | 5/1972 | Clauss |
| 3,706,635 | A | | 12/1972 | Kowalski |
| 3,706,651 | A | | 12/1972 | Leland |
| 3,716,462 | A | | 2/1973 | Jensen |
| 3,878,066 | A | | 4/1975 | Dettke et al. |
| 3,930,963 | A | | 1/1976 | Polichette et al. |
| 3,968,885 | A | | 7/1976 | Hassan et al. |
| 3,984,679 | A | * | 10/1976 | Lublin et al. ..... 378/50 |
| 4,000,046 | A | | 12/1976 | Weaver |
| 4,022,679 | A | | 5/1977 | Koziol et al. |
| 4,046,105 | A | | 9/1977 | Gomez |
| 4,082,638 | A | | 4/1978 | Jumer |
| 4,134,802 | A | | 1/1979 | Herr |
| 4,170,959 | A | | 10/1979 | Aigo |
| 4,238,310 | A | | 12/1980 | Eckler et al. |
| 4,287,029 | A | | 9/1981 | Shimamura |
| 4,304,641 | A | | 12/1981 | Grandia et al. |
| 4,323,433 | A | | 4/1982 | Loch |
| 4,378,283 | A | | 3/1983 | Seyffert |
| 4,384,930 | A | | 5/1983 | Eckles |
| 4,391,694 | A | | 7/1983 | Runsten |
| 4,431,361 | A | | 2/1984 | Bayne |
| 4,437,943 | A | | 3/1984 | Beck |
| 4,449,885 | A | | 5/1984 | Hertel et al. |
| 4,451,197 | A | | 5/1984 | Lange |
| 4,463,503 | A | | 8/1984 | Applegate |
| 4,466,864 | A | | 8/1984 | Bacon |
| 4,495,153 | A | | 1/1985 | Midorikawa |
| 4,495,453 | A | | 1/1985 | Inaba |
| 4,500,394 | A | | 2/1985 | Rizzo |
| 4,566,847 | A | | 1/1986 | Maeda |
| 4,576,689 | A | | 3/1986 | Makkaev |
| 4,604,177 | A | | 8/1986 | Sivilotti |
| 4,604,178 | A | | 8/1986 | Fiegener |
| 4,634,503 | A | | 1/1987 | Nogavich |
| 4,639,028 | A | | 1/1987 | Olson |
| 4,648,944 | A | | 3/1987 | George |
| 4,670,126 | A | | 6/1987 | Messer et al. |
| 4,693,017 | A | | 9/1987 | Oehler et al. |
| 4,760,671 | A | | 8/1988 | Ward |
| 4,761,214 | A | | 8/1988 | Hinman |
| 4,770,590 | A | | 9/1988 | Hugues et al. |
| 4,781,800 | A | | 11/1988 | Goldman |
| 4,800,818 | A | | 1/1989 | Kawaguchi et al. |
| 4,828,654 | A | * | 5/1989 | Reed ..... 205/97 |
| 4,864,239 | A | | 9/1989 | Casarcia et al. |
| 4,898,647 | A | | 2/1990 | Luce et al. |
| 4,902,398 | A | | 2/1990 | Homstad |
| 4,906,341 | A | | 3/1990 | Yamakawa |
| 4,924,890 | A | | 5/1990 | Giles et al. |
| 4,944,650 | A | | 7/1990 | Matsumoto |
| 4,949,671 | A | | 8/1990 | Davis |
| 4,959,278 | A | | 9/1990 | Shimauchi |
| 4,962,726 | A | | 10/1990 | Matsushita et al. |
| 4,988,533 | A | | 1/1991 | Freeman et al. |
| 5,000,827 | A | | 3/1991 | Schuster |
| 5,026,239 | A | | 6/1991 | Chiba |
| 5,054,988 | A | | 10/1991 | Shiraiwa |
| 5,055,036 | A | | 10/1991 | Asano et al. |
| 5,061,144 | A | | 10/1991 | Akimoto |
| 5,078,852 | A | | 1/1992 | Yee |
| 5,083,364 | A | | 1/1992 | Olbrich et al. |
| 5,096,550 | A | | 3/1992 | Mayer |
| 5,110,248 | A | | 5/1992 | Asano et al. |
| 5,115,430 | A | | 5/1992 | Hahne |
| 5,125,784 | A | | 6/1992 | Asano |
| 5,128,912 | A | | 7/1992 | Hug et al. |
| 5,135,636 | A | | 8/1992 | Yee et al. |
| 5,138,973 | A | | 8/1992 | Davis et al. |
| 5,146,136 | A | | 9/1992 | Ogura |
| 5,151,168 | A | | 9/1992 | Gilton |
| 5,156,174 | A | | 10/1992 | Thompson |
| 5,156,730 | A | | 10/1992 | Bhatt |
| 5,168,886 | A | | 12/1992 | Thompson et al. |
| 5,168,887 | A | | 12/1992 | Thompson |
| 5,172,803 | A | | 12/1992 | Lewin |
| 5,174,045 | A | | 12/1992 | Thompson et al. |
| 5,178,512 | A | | 1/1993 | Skrobak |
| 5,178,639 | A | | 1/1993 | Nishi |
| 5,180,273 | A | | 1/1993 | Salaya et al. |
| 5,183,377 | A | | 2/1993 | Becker et al. |
| 5,186,594 | A | | 2/1993 | Toshima et al. |
| 5,209,817 | A | | 5/1993 | Ahmad |
| 5,217,586 | A | | 6/1993 | Datta |
| 5,222,310 | A | | 6/1993 | Thompson |
| 5,227,041 | A | | 7/1993 | Brogden |
| 5,228,232 | A | | 7/1993 | Miles |
| 5,228,966 | A | | 7/1993 | Murata |
| 5,232,511 | A | | 8/1993 | Bergman |
| 5,235,995 | A | | 8/1993 | Bergman et al. |
| 5,238,500 | A | | 8/1993 | Bergman |
| 5,252,137 | A | | 10/1993 | Tateyama et al. |
| 5,256,262 | A | | 10/1993 | Blomsterberg |
| 5,256,274 | A | | 10/1993 | Poris |
| 5,301,700 | A | | 4/1994 | Kamikawa et al. |
| 5,302,464 | A | | 4/1994 | Nomura |
| 5,314,294 | A | | 5/1994 | Taniguchi |
| 5,316,642 | A | | 5/1994 | Young |
| 5,326,455 | A | | 7/1994 | Kubo et al. |
| 5,332,445 | A | | 7/1994 | Bergman |
| 5,344,491 | A | | 9/1994 | Katou |
| 5,368,711 | A | | 11/1994 | Poris |
| 5,372,848 | A | | 12/1994 | Blackwell et al. |
| 5,376,176 | A | | 12/1994 | Kuriyama |
| 5,377,708 | A | | 1/1995 | Bergman |
| 5,388,945 | A | | 2/1995 | Garric et al. |
| 5,391,285 | A | | 2/1995 | Lytle |
| 5,421,987 | A | | 6/1995 | Tzanavaras et al. |
| 5,429,733 | A | | 7/1995 | Ishida |
| 5,437,777 | A | | 8/1995 | Kishi |
| 5,442,416 | A | | 8/1995 | Tateyama et al. |
| 5,443,707 | A | | 8/1995 | Mori |
| 5,445,484 | A | | 8/1995 | Kato et al. |
| 5,460,478 | A | | 10/1995 | Akimoto et al. |
| 5,464,313 | A | | 11/1995 | Ohsawa |
| 5,472,502 | A | | 12/1995 | Batchelder |
| 5,489,341 | A | | 2/1996 | Bergman et al. |
| 5,500,081 | A | | 3/1996 | Bergman |
| 5,516,412 | A | | 5/1996 | Andricacos et al. |
| 5,522,975 | A | | 6/1996 | Andricacos et al. |
| 5,527,390 | A | | 6/1996 | Ono et al. |
| 5,544,421 | A | | 8/1996 | Thompson et al. |
| 5,549,808 | A | | 8/1996 | Farooq |
| 5,571,325 | A | | 11/1996 | Ueyama et al. |
| 5,575,611 | A | | 11/1996 | Thompson et al. |
| 5,584,310 | A | | 12/1996 | Bergman |
| 5,597,460 | A | | 1/1997 | Reynolds |
| 5,620,581 | A | | 4/1997 | Ang |
| 5,639,206 | A | | 6/1997 | Oda et al. |
| 5,639,316 | A | | 6/1997 | Cabral |
| 5,658,387 | A | | 8/1997 | Reardon |
| 5,660,517 | A | | 8/1997 | Thompson et al. |
| 5,662,788 | A | | 9/1997 | Sandhu |
| 5,664,337 | A | | 9/1997 | Davis et al. |
| 5,670,034 | A | | 9/1997 | Lowery |
| 5,676,337 | A | | 10/1997 | Giras et al. |
| 5,678,320 | A | | 10/1997 | Thompson et al. |
| 5,681,392 | A | | 10/1997 | Swain |
| 5,684,713 | A | | 11/1997 | Asada et al. |
| 5,700,127 | A | | 12/1997 | Harada |
| 5,711,646 | A | | 1/1998 | Ueda et al. |

| | | | | |
|---|---|---|---|---|
| 5,723,028 | A | | 3/1998 | Poris |
| 5,731,678 | A | * | 3/1998 | Zila et al. ..... 318/568.11 |
| 5,744,019 | A | | 4/1998 | Ang |
| 5,746,565 | A | | 5/1998 | Tepolt |
| 5,754,842 | A | | 5/1998 | Minagawa |
| 5,759,006 | A | | 6/1998 | Miyamoto et al. |
| 5,762,751 | A | | 6/1998 | Bleck |
| 5,765,444 | A | | 6/1998 | Bacchi |
| 5,765,889 | A | | 6/1998 | Nam et al. |
| 5,785,826 | A | | 7/1998 | Greenspan |
| 5,871,626 | A | | 2/1999 | Crafts |
| 5,871,805 | A | | 2/1999 | Lemelson |
| 5,882,498 | A | | 3/1999 | Dubin |
| 5,908,543 | A | | 6/1999 | Matsunami |
| 5,925,227 | A | | 7/1999 | Kobayashi et al. |
| 5,932,077 | A | | 8/1999 | Reynolds |
| 5,980,706 | A | | 11/1999 | Bleck |
| 5,985,126 | A | | 11/1999 | Bleck |
| 5,989,397 | A | | 11/1999 | Laube et al. |
| 5,989,406 | A | | 11/1999 | Beetz |
| 5,999,886 | A | | 12/1999 | Martin et al. |
| 6,004,828 | A | | 12/1999 | Hanson |
| 6,027,631 | A | | 2/2000 | Broadbent |
| 6,028,986 | A | | 2/2000 | Song |
| 6,051,284 | A | | 4/2000 | Byrne |
| 6,053,687 | A | | 4/2000 | Kirkpatrick |
| 6,074,544 | A | | 6/2000 | Reid |
| 6,090,260 | A | | 7/2000 | Inoue |
| 6,091,498 | A | | 7/2000 | Hanson |
| 6,099,702 | A | | 8/2000 | Reid |
| 6,099,712 | A | | 8/2000 | Ritzdorf |
| 6,110,011 | A | | 8/2000 | Somekh |
| 6,110,346 | A | | 8/2000 | Reid |
| 6,136,163 | A | | 10/2000 | Cheung |
| 6,139,712 | A | | 10/2000 | Patton |
| 6,140,234 | A | | 10/2000 | Uzoh et al. |
| 6,143,155 | A | | 11/2000 | Adams |
| 6,151,532 | A | | 11/2000 | Barone et al. |
| 6,156,167 | A | | 12/2000 | Patton |
| 6,159,354 | A | | 12/2000 | Contolini |
| 6,162,344 | A | | 12/2000 | Reid |
| 6,162,488 | A | | 12/2000 | Gevelber et al. |
| 6,168,695 | B1 | | 1/2001 | Woodruff |
| 6,174,425 | B1 | | 1/2001 | Simpson |
| 6,174,796 | B1 | | 1/2001 | Takagi et al. |
| 6,179,983 | B1 | | 1/2001 | Reid |
| 6,193,859 | B1 | | 2/2001 | Contolini |
| 6,199,301 | B1 | | 3/2001 | Wallace |
| 6,221,230 | B1 | | 4/2001 | Takeuchi |
| 6,228,232 | B1 | | 5/2001 | Woodruff |
| 6,234,738 | B1 | | 5/2001 | Kimata |
| 6,251,238 | B1 | | 6/2001 | Kaufman et al. |
| 6,251,528 | B1 | | 6/2001 | Uzoh et al. |
| 6,258,220 | B1 | | 7/2001 | Dordi |
| 6,261,433 | B1 | | 7/2001 | Landau |
| 6,270,647 | B1 | | 8/2001 | Graham |
| 6,277,263 | B1 | | 8/2001 | Chen |
| 6,318,951 | B1 | | 11/2001 | Schmidt |
| 6,322,112 | B1 | | 11/2001 | Duncan |
| 6,322,677 | B1 | | 11/2001 | Woodruff |
| 6,342,137 | B1 | | 1/2002 | Woodruff |
| 6,365,729 | B1 | | 4/2002 | Tyagi |
| 6,391,166 | B1 | | 5/2002 | Wang |
| 6,402,923 | B1 | | 6/2002 | Mayer |
| 6,444,101 | B1 | | 9/2002 | Stevens |
| 6,481,956 | B1 | | 11/2002 | Hofmeister |
| 6,491,806 | B1 | | 12/2002 | Dubin |
| 6,497,801 | B1 | * | 12/2002 | Woodruff et al. ..... 204/230.2 |
| 6,562,421 | B1 | | 5/2003 | Sudo |
| 6,565,729 | B1 | | 5/2003 | Chen |
| 6,569,297 | B1 | | 5/2003 | Wilson |
| 6,599,412 | B1 | | 7/2003 | Graham |
| 6,623,609 | B1 | | 9/2003 | Harris |
| 6,632,334 | B1 | | 10/2003 | Anderson |
| 6,660,137 | B1 | | 12/2003 | Wilson |
| 6,678,055 | B1 | | 1/2004 | Du-Nour et al. |
| 6,699,373 | B1 | | 3/2004 | Woodruff |
| 6,709,562 | B1 | | 3/2004 | Andricacos et al. |
| 6,755,954 | B1 | | 6/2004 | Mayer et al. |
| 6,773,571 | B1 | | 8/2004 | Mayer |
| 2001/0024611 | A1 | | 9/2001 | Woodruff |
| 2001/0032788 | A1 | | 10/2001 | Woodruff |
| 2001/0043856 | A1 | | 11/2001 | Woodruff |
| 2002/0008036 | A1 | | 1/2002 | Wang |
| 2002/0008037 | A1 | | 1/2002 | Wilson |
| 2002/0032499 | A1 | | 3/2002 | Wilson |
| 2002/0046952 | A1 | | 4/2002 | Graham |
| 2002/0125141 | A1 | | 9/2002 | Wilson |
| 2002/0139678 | A1 | | 10/2002 | Wilson |
| 2003/0038035 | A1 | | 2/2003 | Wilson |
| 2003/0062258 | A1 | | 4/2003 | Woodruff |
| 2003/0070918 | A1 | | 4/2003 | Hanson |
| 2003/0127337 | A1 | | 7/2003 | Hanson |
| 2004/0031693 | A1 | | 2/2004 | Chen |
| 2004/0055877 | A1 | | 3/2004 | Wilson |
| 2004/0099533 | A1 | | 5/2004 | Wilson |

FOREIGN PATENT DOCUMENTS

| | | | | |
|---|---|---|---|---|
| DE | 41 14 427 | | | 11/1992 |
| DE | 195 25 666 | | | 10/1996 |
| EP | 0 140 404 | A1 | | 8/1984 |
| EP | 0047132 | B1 | | 7/1985 |
| EP | 0 677 612 | A3 | | 10/1985 |
| EP | 0 257 670 | | | 3/1988 |
| EP | 0 290 210 | | | 11/1988 |
| EP | 0 677 612 | A2 | | 10/1995 |
| EP | 0582019 | B1 | | 10/1995 |
| EP | 0544311 | B1 | | 5/1996 |
| EP | 0 881 673 | A2 | | 5/1998 |
| EP | 0 982 771 | A1 | | 8/1999 |
| EP | 1 069 213 | A2 | | 7/2000 |
| EP | 0452939 | B1 | | 11/2000 |
| GB | 2217107 | A | | 3/1989 |
| GB | 2 254 288 | A | | 3/1992 |
| GB | 2 279 372 | A | | 6/1994 |
| JP | 59-150094 | A | * | 8/1984 |
| JP | 1048442 | | | 2/1989 |
| JP | 4144150 | | | 5/1992 |
| JP | 4311591 | | | 11/1992 |
| JP | 5146984 | | | 6/1993 |
| JP | 5195183 | A | | 8/1993 |
| JP | 5211224 | | | 8/1993 |
| JP | 6017291 | A | | 1/1994 |
| JP | 6073598 | A | | 3/1994 |
| JP | 6224202 | A | | 8/1994 |
| JP | 7113159 | A | | 5/1995 |
| JP | 7197299 | A | | 8/1995 |
| JP | 10-083960 | | | 3/1998 |
| JP | 11036096 | A | | 2/1999 |
| JP | 11080993 | A | | 3/1999 |
| WO | WO-90/00476 | | | 1/1990 |
| WO | WO-91/04213 | | | 4/1991 |
| WO | WO-95/06326 | | | 3/1995 |
| WO | WO-95/20064 | | | 7/1995 |
| WO | WO-99/16936 | | | 4/1996 |
| WO | WO-99/25904 | | | 5/1999 |
| WO | WO-99/25905 | | | 5/1999 |
| WO | WO-99/40615 | | | 8/1999 |
| WO | WO-99/41434 | | | 8/1999 |
| WO | WO-99/45745 | | | 9/1999 |
| WO | WO-00/02675 | | | 1/2000 |
| WO | WO-00/02808 | A1 | | 1/2000 |
| WO | WO-00/03072 | | | 1/2000 |
| WO | WO-00/32835 | | | 6/2000 |
| WO | WO-00/61498 | | | 10/2000 |

| | | |
|---|---|---|
| WO | WO-00/61837 | 10/2000 |
| WO | WO-01/46910 | 6/2001 |
| WO | WO-01/09434 | 11/2001 |
| WO | WO-01/91163 | 11/2001 |
| WO | WO-02/17203 | 2/2002 |
| WO | WO-02/045476 | 6/2002 |
| WO | WO-02/97165 | 12/2002 |
| WO | WO-02/99165 | 12/2002 |
| WO | WO-03/18874 | 3/2003 |

OTHER PUBLICATIONS

Contolini et al., "Copper Electroplating Process for Sub-Half-Micron ULSI Structures," VMIC Conference 1995 ISMIC—04/95/0322, pp. 322-328, Jun. 17-29, 1995.
Devaraj et al., "Pulsed Electrodeposition of Copper," Plating & Surface Finishing, pp. 72-78, Aug. 1992.
Dubin, "Copper Plating Techniques for ULSI Metallization," Advanced MicroDevices, no date.
Dubin, V.M., "Electrochemical Deposition of Copper for On-Chip Interconnects," Advanced MicroDevices, no date.
Gauvin et al., "The Effect of Chloride Ions on Copper Deposition," J. of Electrochemical Society, vol. 99, pp. 71-75, Feb. 1952.
Lee, Tien-Yu Tom et al., "Application of a CFD Tool in Designing a Fountain Plating Cell for Uniform Bump Plating of Semiconductor Wafers," IEEE Transactions on Components, Packaging and Manufacturing Technology, Feb. 1996, pp. 131-137, vol. 19, No. 1.
Lowenheim, F.A., "Electroplating," Jan. 1979, 12 pgs, McGraw-Hill Book Company.
Lowenheim, Frederick A., "Electroplating Electrochemistry Applied to Electroplating," 1978, pp. 152-155, McGraw-Hill Book Company, New York, no month.
Osero, N.M., "An Overview of Pulse Plating," Plating and Surface Finishing, Mar. 1986.
Passal, F., "Copper Plating During the Last Fifty Years," Plating, pp. 628-638, Jun. 1959.
Patent Abstract of Japan, "Partial Plating Device," Publciation No. 01234590, Publication Date: Sep. 19, 1989.
Patent Abstract of Japan, "Plating Method"Publication No. 57171690, Publication Date: Oct. 22, 1982.
Singer, P., "Copper Goes Mainstream: Low k to Follow," Semiconductor International, pp. 67-70, Nov. 1997.
Dubin, V.M., "Electrochemical Deposition of Copper for On-Chip Interconnects," Advanced MicroDevices.
Patent Abstract of Japan, "Organic Compound and its Application," Publication No. 08-003153, Publication Date: Jan. 9, 1996.
Patent Abstract of Japan, English Abstract Translation—Japanese Utility Model No. 2538705, Publication Date: Aug. 25, 1992.
Ritter, et al., "Two-And Three-Dimensional Numberical Modeling of Copper Electroplating For Advanced ULSI Metallization", E-MRS Conference, Symposium M, *Basic Models to Enhance Reliability*, Strasbourg (France), 1999.

* cited by examiner

TURNING ELECTRODES USED IN A REACTOR FOR ELECTROCHEMICALLY PROCESSING A MICROELECTRONIC WORKPIECE

CROSS-REFERENCES TO RELATED APPLICATIONS

The present application is a continuation-in-part of U.S. patent applicaton Ser. No. 09/849,505, filed May 4, 2001, now U.S. Pat. No. 7,020,537, which claims the benefit of U.S. Provisional Patent Application No. 60/206,663, filed May 24, 2000, and which is a continuation-in-part of International Patent Application No. PCT/US00/10120, filed Apr. 13, 2000, designating the United States and claiming the benefit of U.S. Provisional Patent Application Nos. 60/182,160, filed Feb. 14, 2000, 60/143,769, filed Jul. 12, 1999, and 60/129,055, filed Apr. 13, 1999; and this application claims the benefit of provisional application No. 60/206,663, filed May 24, 2000; the disclosures of each of which are hereby expressly incorporated by reference in their entireties.

FIELD OF THE INVENTION

The present invention is directed to the field of automatic process control, and, more particularly, to the field of controlling a material deposition process.

BACKGROUND OF THE INVENTION

The fabrication of microelectronic components from a microelectronic workpiece, such as a semiconductor wafer substrate, polymer substrate, etc., involves a substantial number of processes. For purposes of the present application, a microelectronic workpiece is defined to include a workpiece formed from a substrate upon which microelectronic circuits or components, data storage elements or layers, and/or micro-mechanical elements are formed. There are a number of different processing operations performed on the microelectronic workpiece to fabricate the microelectronic component(s). Such operations include, for example, material deposition, patterning, doping, chemical mechanical polishing, electropolishing, and heat treatment.

Material deposition processing involves depositing or otherwise forming thin layers of material on the surface of the microelectronic workpiece. Patterning provides selective deposition of a thin layer and/or removal of selected portions of these added layers. Doping of the semiconductor wafer, or similar microelectronic workpiece, is the process of adding impurities known as "dopants" to selected portions of the wafer to alter the electrical characteristics of the substrate material. Heat treatment of the microelectronic workpiece involves heating and/or cooling the workpiece to achieve specific process results. Chemical mechanical polishing involves the removal of material through a combined chemical/mechanical process while electropolishing involves the removal of material from a workpiece surface using electrochemical reactions.

Numerous processing devices, known as processing "tools," have been developed to implement one or more of the foregoing processing operations. These tools take on different configurations depending on the type of workpiece used in the fabrication process and the process or processes executed by the tool. One tool configuration, known as the LT-210C™ processing tool and available from Semitool, Inc., of Kalispell, Mont., includes a plurality of microelectronic workpiece processing stations that are serviced by one or more workpiece transfer robots. Several of the workpiece processing stations utilize a workpiece holder and a process bowl or container for implementing wet processing operations. Such wet processing operations include electroplating, etching, cleaning, electroless deposition, electropolishing, etc. In connection with the present invention, it is the electrochemical processing stations used in the LT-210™ that are noteworthy. Such electrochemical processing stations perform the foregoing electroplating, electropolishing, anodization, etc., of the microelectronic workpiece. It will be recognized that the electrochemical processing system set forth herein is readily adapted to implement each of the foregoing electrochemical processes.

In accordance with one configuration of the LT-210™ tool, the electrochemical processing stations include a workpiece holder and a process container that are disposed proximate one another. The workpiece holder and process container are operated to bring the microelectronic workpiece held by the workpiece holder into contact with an electrochemical processing fluid disposed in the process container. When the microelectronic workpiece is positioned in this manner, the workpiece holder and process container form a processing chamber that may be open, enclosed, or substantially enclosed.

Electroplating and other electrochemical processes have become important in the production of semiconductor integrated circuits and other microelectronic devices from microelectronic workpieces. For example, electroplating is often used in the formation of one or more metal layers on the is workpiece. These metal layers are often used to electrically interconnect the various devices of the integrated circuit. Further, the structures formed from the metal layers may constitute microelectronic devices such as read/write heads, etc.

Electroplated metals typically include copper, nickel, gold, platinum, solder, nickel-iron, etc. Electroplating is generally effected by initial formation of a seed layer on the microelectronic workpiece in the form of a very thin layer of metal, whereby the surface of the microelectronic workpiece is rendered electrically conductive. This electro-conductivity permits subsequent formation of a blanket or patterned layer of the desired metal by electroplating. Subsequent processing, such as chemical mechanical planarization, may be used to remove unwanted portions of the patterned or metal blanket layer formed during electroplating, resulting in the formation of the desired metallized structure.

Electropolishing of metals at the surface of a workpiece involves the removal of at least some of the metal using an electrochemical process. The electrochemical process is effectively the reverse of the electroplating reaction and is often carried out using the same or similar reactors as electroplating.

Anodization typically involves oxidizing a thin-film layer at the surface of the workpiece. For example, it may be desirable to selectively oxidize certain portions of a metal layer, such as a Cu layer, to facilitate subsequent removal of the selected portions in a solution that etches the oxidized material faster than the non-oxidized material. Further, anodization may be used to deposit certain materials, such as perovskite materials, onto the surface of the workpiece.

As the size of various microelectronic circuits and components decreases, there is a corresponding decrease in the manufacturing tolerances that must be met by the manufacturing tools. In connection with the present invention as described below, electrochemical processes must uniformly process the surface of a given microelectronic workpiece.

Further, the electrochemical process must meet workpiece-to-workpiece uniformity requirements.

Electrochemical processes may be conducted in reaction chambers having either a single electrode or multiple electrodes. Where a single-electrode reaction chamber is used, improving the level uniformity achieved by the process often involves manual trial-and-error modifications to the hardware configuration of the reaction chamber. For example, operators of the process may experiment with repositioning or reorienting the electrode, the workpiece, or a baffle separating the electrode from the workpiece, or may modify aspects of a fluid flow within the reaction chamber in attempts to improve the level uniformity achieved by the process.

In a multiple-electrode reaction chamber, two or more electrodes are arranged in some pattern. Each of the electrodes is connected to an electrical power supply that provides the electrical power used to execute the electrochemical processing operations. Preferably, at least some of the electrodes are connected to different electrical nodes so that the electrical power provided to them by the power supply may be provided independent of the electrical power provided to other electrodes in the array.

Electrode arrays having a plurality of electrodes facilitate localized control of the electrical parameters used to electrochemically process the microelectronic workpiece. This localized control of the electrical parameters can be used to provide greater uniformity of the electrochemical processing across the surface of the microelectronic workpiece when compared to single electrode systems without necessitating hardware changes. However, determining the electrical parameters for each of the electrodes in the array to achieve the desired process uniformity can be problematic. Typically, the electrical parameter (i.e., electrical current, voltage, etc.) for a given electrode in a given electrochemical process is determined experimentally using a manual trial and error approach.

Using such a manual trial and error approach, however, can be very time-consuming. Further, the electrical parameters do not easily translate to other electrochemical processes. For example, a given set of electrical parameters used to electroplate a metal to a thickness X onto the surface of a microelectronic workpiece cannot easily be used to derive the electrical parameters used to electroplate a metal to a thickness Y. Still further, the electrical parameters used to electroplate a desired film thickness X of a given metal (e.g., copper) are generally not suitable for use in electroplating another metal (e.g., platinum). Similar deficiencies in this trial and error approach are associated with other types of electrochemical processes (i.e., anodization, electropolishing, etc.). Also, this manual trial and error approach often must be repeated in several common circumstances, such as when the thickness or level of uniformity of the seed layer changes, when the target plating thickness or profile changes, or when the plating rate changes.

In view of the foregoing, a system for electrochemically processing a microelectronic workpiece that can be used to automatically identify electrical parameters that cause a multiple electrode array to achieve a high level of uniformity for a wide range of electrochemical processing variables (e.g., seed layer thicknesses, seed layer types, electroplating materials, etc.) would have significant utility.

SUMMARY

In the following, a facility for automatically identifying electrical parameters that produce a high level of uniformity in electrochemically processing a microelectronic workpiece is described. Embodiments of this facility are adapted to accommodate various electrochemical processes; reactor designs and conditions;

plating materials and solutions; workpiece dimensions, materials, and conditions, and the nature and condition of existing coatings on the workpiece. Accordingly, use of the facility may typically result in substantial automation of electrochemical processing, even where a large number of variables in different dimensions are present. Such automation has the capacity to reduce the cost of skilled labor required to oversee a processing operation, as well as increase output quality and throughput. Additionally, use of the facility can both streamline and improve the process of designing new electroplating reactors.

In one exemplary embodiment, the facility is embodied in a processing container for electrochemically processing a microelectronic workpiece. The processing container includes a principal fluid flow chamber. At different elevations in the principal fluid flow chamber, a number of concentric anodes are disposed so as to place the concentric anodes at different distances from a microelectronic workpiece under process. The processing container further includes a controller that is configured to deliver through each of the concentric anodes a current that is both (a) based upon a current delivery through the concentric anode to process an earlier-processed microelectronic workpiece and (b) selected to produce a more uniform processing of the workpiece under process then the processing of the earlier-processed microelectronic workpiece.

In another exemplary embodiment, the facility electroplates the material on a microelectronic workpiece. The facility introduces at least one surface of the microelectronic workpiece into an electroplating bath. The facility provides a plurality of anodes in the electroplating bath, spaced at different distances from the surface of the microelectronic workpiece that is to be electroplated. For each of the anodes, the facility induces an electrical current between the anode and the surface of the microelectronic workpiece. The induced electrical current is (a) based on an electrical current induced between the anode and a previously electroplated microelectronic workpiece and (b) selected to improve on an electroplating result achieved for the previously electroplated microelectronic workpiece.

In a further exemplary embodiment, the facility performs a sensitivity analysis of the electroplating that is a basis for selecting the induced electric currents.

DETAILED DESCRIPTION

Figure 1:
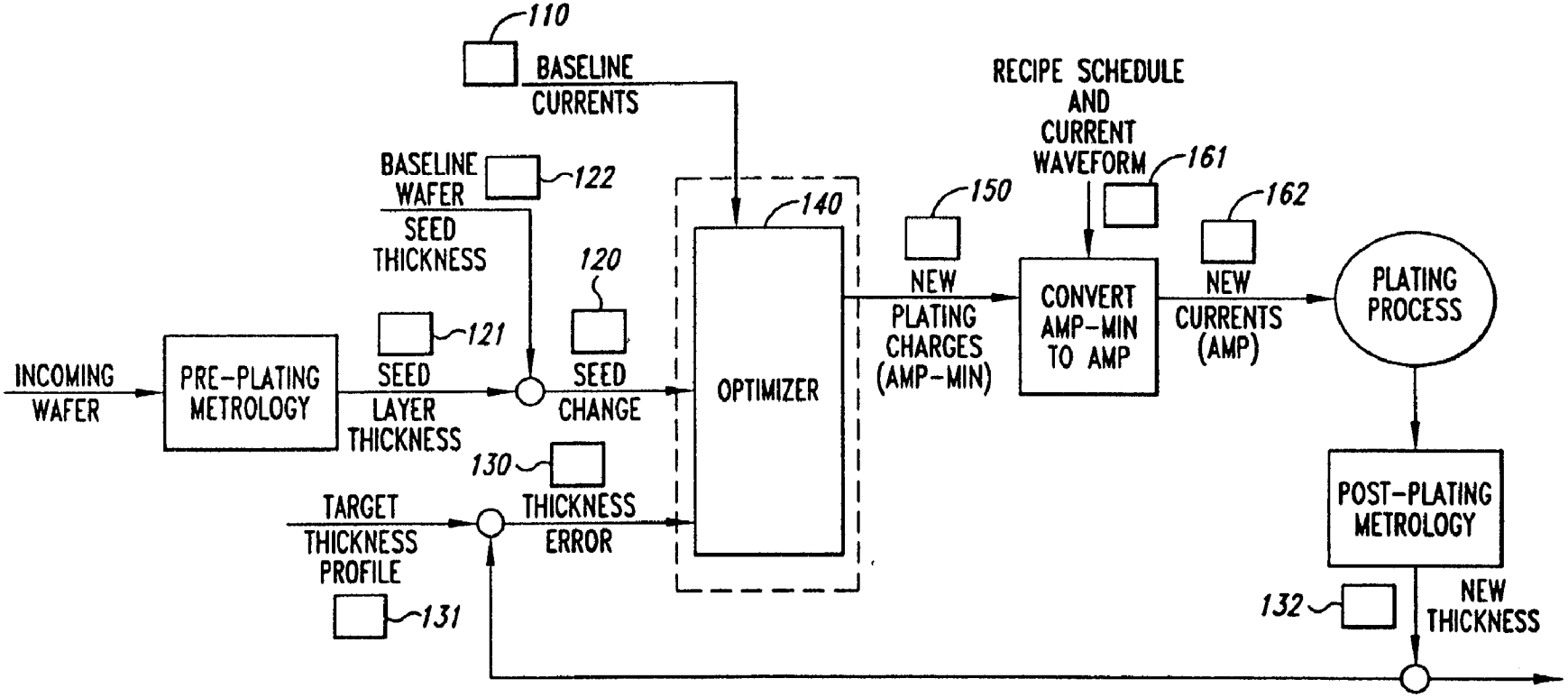
FIG. 1 is a process schematic diagram showing inputs and outputs of the optimizer.

A facility for automatically selecting and refining electrical parameters for processing a microelectronic workpiece ("the optimizer") is disclosed. In many embodiments, the optimizer determines process parameters affecting the processing of a round workpiece as a function of processing results at various radii on the workpiece. In some embodiments, the optimizer adjusts the electrode currents for a multiple electrode electroplating chamber, such as multiple anode reaction chambers of the Paragon tool provided by Semitool, Inc. of Kalispell, Mont., in order to achieve a specified thickness profile (i.e., flat, convex, concave, etc.) of a coating, such as a metal or other conductor, applied to a semiconductor wafer. The optimizer adjusts electrode currents for successive workpieces to compensate for changes in the thickness of the seed layer of the incoming workpiece (a source of feed forward control), and/or to correct for non-uniformities produced in prior wafers at the anode currents used to plate them (a source of feedback control). In this way, the optimizer is able to quickly achieve a high level of uniformity in the coating deposited on workpieces without substantial manual intervention.

The facility typically operates an electroplating chamber containing a principal fluid flow chamber, and a plurality of electrodes disposed in the principal fluid flow chamber. The electroplating chamber typically further contains a workpiece holder positioned to hold at least one surface of the microelectronic workpiece in contact with an electrochemical processing fluid in the principal fluid flow chamber, at least during electrochemical processing of the microelectronic workpiece. One or more electrical contacts are configured to contact the at least one surface of the microelectronic workpiece, and an electrical power supply is connected to the one or more electrical contacts and to the plurality of electrodes. At least two of the plurality of electrodes are independently connected to the electrical power supply to facilitate independent supply of power thereto. The apparatus also includes a control system that is connected to the electrical power supply to control at least one electrical power parameter respectively associated with each of the independently connected electrodes. The control system sets the at least one electrical power parameter for a given one of the independently connected electrodes based on one or more user input parameters and a plurality of predetermined sensitivity values; wherein the sensitivity values correspond to process perturbations resulting from perturbations of the electrical power parameter for the given one of the independently connected electrodes.

For example, although the present invention is described in the context of electrochemical processing of the microelectronic workpiece, the teachings herein can also be extended to other types of microelectronic workpiece processing. In effect, the teachings herein can be extended to other microelectronic workpiece processing systems that have individually controlled processing elements that are responsive to control parameters and that have interdependent effects on a physical characteristic of the microelectronic workpiece that is processed using the elements. Such systems may employ sensitivity tables or matrices as set forth herein and use them in calculations with one or more input parameters sets to arrive at control parameter values that accurately result in the targeted physical characteristic of the microelectronic workpiece.

FIG. 1 is a process schematic diagram showing inputs and outputs of the optimizer. FIG. 1 shows that the optimizer 140 uses up to three sources of input: baseline currents 110, seed change 120, and thickness error 130. The baseline currents 110 are the anode currents used to plate the previous wafer or another set of currents for which plating thickness results are known. For the first workpiece in a sequence of workpieces, the baseline currents used to plate the wafer are typically specified by a source other than the optimizer. For example, they may be specified by a recipe used to plate the wafers, or may be manually determined.

The seed change 120 is the difference between the thickness of the seed layer of the incoming wafer 121 and the thickness of the seed layer of the previous plated wafer 122. The seed change input 120 is said to be a source of feed-forward control in the optimizer, in that it incorporates information about the upcoming plating cycle, as it reflects the measurement the wafer to be plated in the upcoming plating cycle. Thickness error 130 is the difference in thickness between the previous plated wafer 132 and the target thickness profile 131 specified for the upcoming plating cycle. The thickness error 130 is said to be a source of feedback control, because it incorporates information from an earlier plating cycle, that is, the thickness of the wafer plated in the previous plating cycle.

FIG. 1 further shows that the optimizer outputs new plating charges 150 for each electrode in the upcoming plating cycle, expressed in amp-minute units. The new plating charges output is combined with a recipe schedule and a current waveform 161 to generate the currents 162, in amps, to be delivered through each electrode at each point in the recipe schedule. These new currents are used by the plating process to plate a wafer in the next plating cycle. In embodiments in which different types of power supplies are used, other types of control parameters are generated by the optimizer for use in operating the power supply. For example, where a voltage control power supply is used, the control parameters generated by the optimizer are voltages, expressed in volts. The wafer so plated is then subjected to post-plating metrology to measure its plated thickness 132.

While the optimizer is shown as receiving inputs and producing outputs at various points in the processing of these values, it will be understood by those in the art that the optimizer may be variously defined to include or exclude aspects of such processing. For example, while FIG. 1 shows the generation of seed change from baseline wafer seed thickness and seed layer thickness outside the optimizer, it is contemplated that such generation may alternatively be performed within the optimizer.

Figure 2:
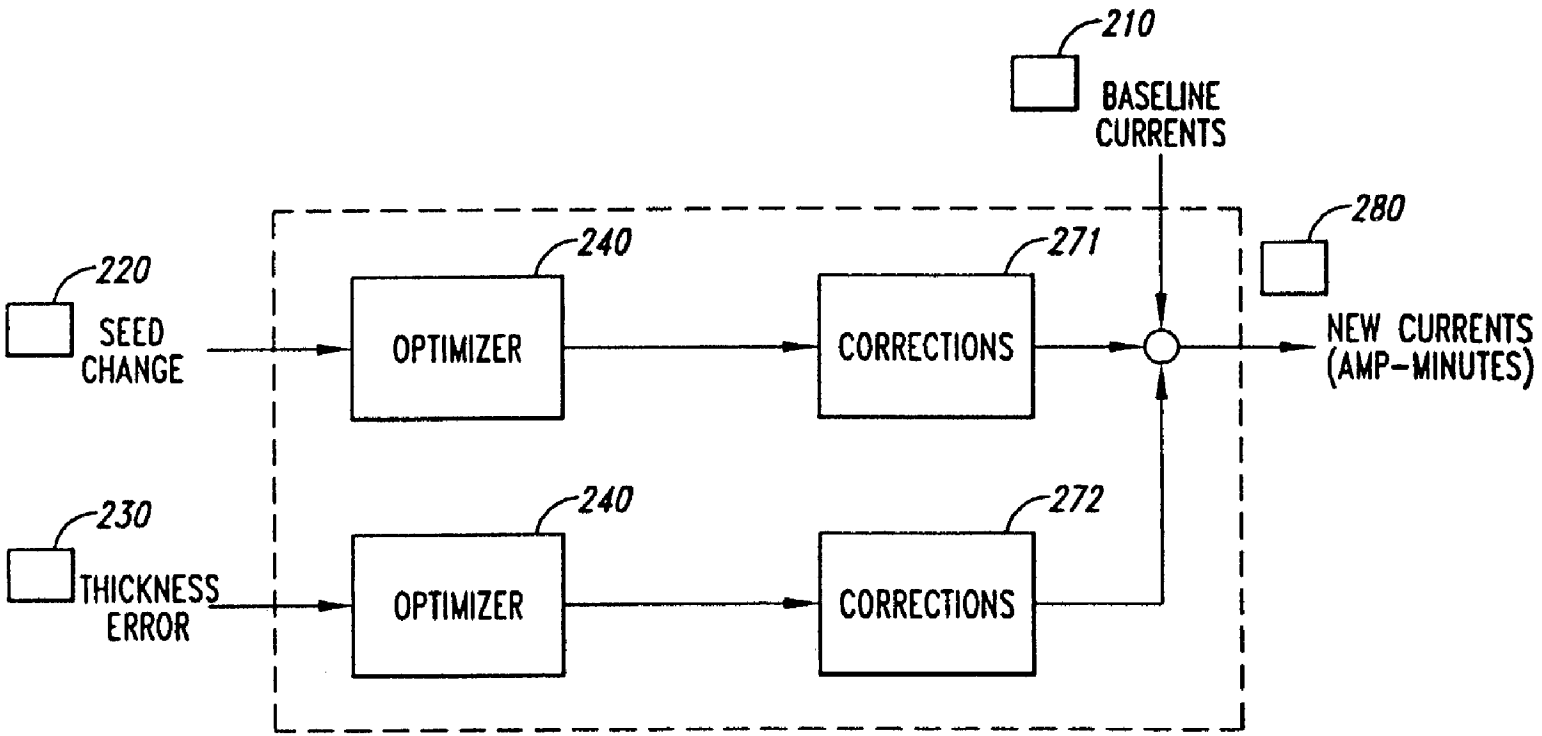
FIG. 2 is a process schematic diagram showing a branched correction system utilized by some embodiments of the optimizer.

FIG. 2 is a process schematic diagram showing a branched correction system utilized by some embodiments of the optimizer. The branched adjustment system utilizes two independently-engageable correction adjustments, a feedback adjustment (230, 240, 272) due to thickness errors and a feed forward adjustment (220, 240, 271) due to incoming seed layer thickness variation. When the anode currents produce an acceptable uniformity, the feedback loop may be disengaged from the transformation of baseline currents 210 to new currents 280. The feed forward compensation may be disengaged in situations where the seed layer variations are not expected to affect thickness uniformity. For example, after the first wafer of a similar batch is corrected for, the feed-forward compensation may be disengaged and the corrections may be applied to each sequential wafer in the batch.

Figure 3:
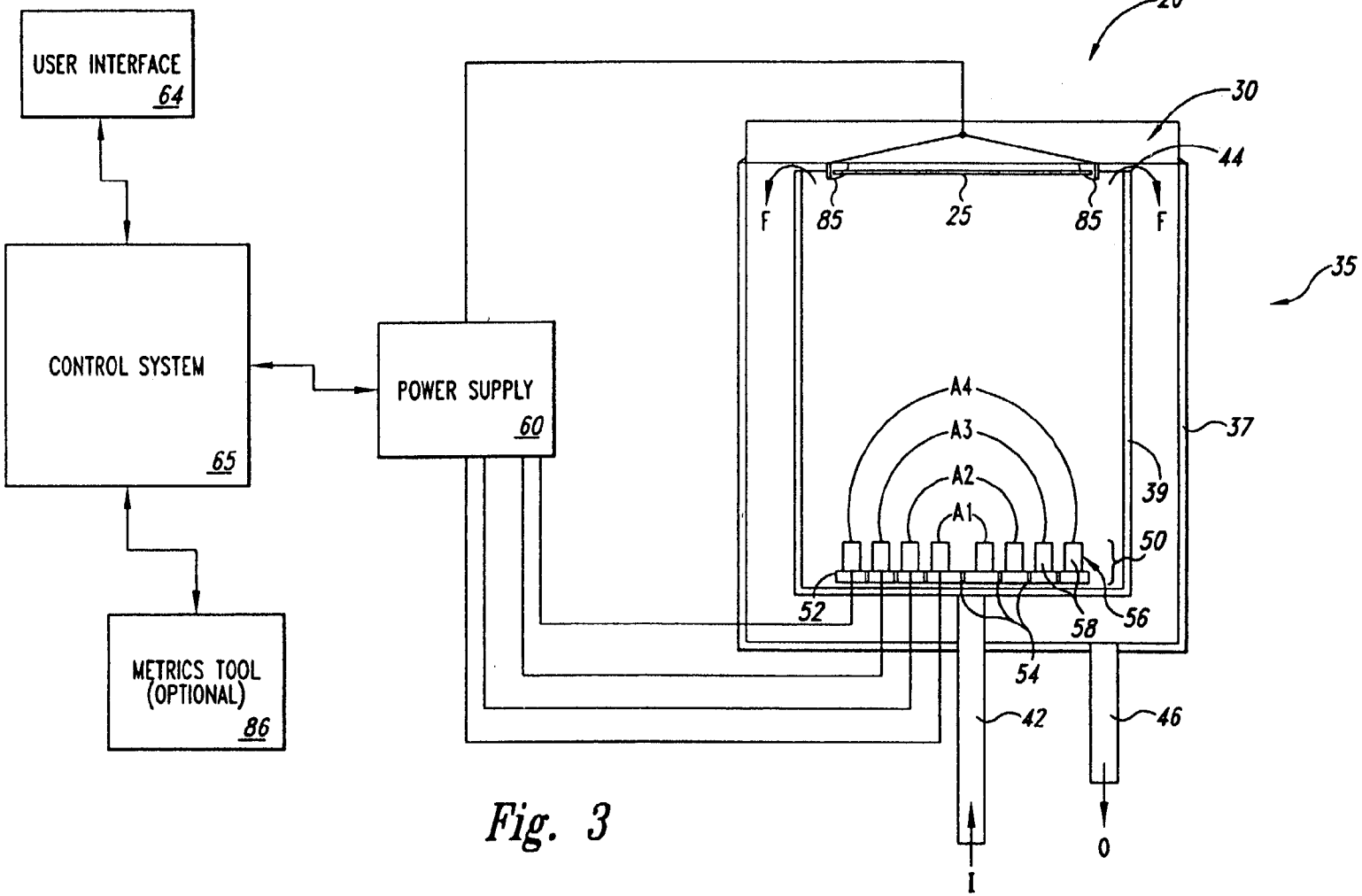
FIG. 3 is schematic block diagram of an electrochemical processing system constructed in accordance with one embodiment of the optimizer.

FIG. 3 is schematic block diagram of an electrochemical processing system constructed in accordance with one embodiment of the optimizer. FIG. 3 shows a reactor assembly 20 for electrochemically processing a microelectronic workpiece 25, such as a semiconductor wafer, that can be used in connection with the present invention. Generally stated, an embodiment of the reactor assembly 20 includes a reactor head 30 and a corresponding reactor base or container shown generally at 35. The reactor base 35 can be a bowl and cup assembly for containing a flow of an electrochemical processing solution. The reactor 20 of FIG. 3 can be used to implement a variety of electrochemical processing operations such as electroplating, electropolishing, anodization, etc., as well as to implement a wide variety of other material deposition techniques. For purposes of the following discussion, aspects of the specific embodiment set forth herein will be described, without limitation, in the context of an electroplating process.

The reactor head 30 of the reactor assembly 20 can include a stationary assembly (not shown) and a rotor assembly (not shown). The rotor assembly may be configured to receive and carry an associated microelectronic workpiece 25, position the microelectronic workpiece in a process-side down orientation within reactor container 35, and to rotate or spin the workpiece. The reactor head 30 can also include one or more contacts 85 (shown schematically) that provide electroplating power to the surface of the microelectronic workpiece. In the illustrated embodiment, the contacts 85 are configured to contact a seed layer or other conductive material that is to be plated on the plating surface microelectronic workpiece 25. It will be recognized, however, that the contacts 85 can engage either the front side or the backside of the workpiece depending upon the appropriate conductive path between the contacts and the area that is to be plated. Suitable reactor heads 30 with contacts 85 are disclosed in U.S. Pat. No. 6,080,291 and U.S. application Ser. Nos. 09/386,803; 09/386,610; 09/386,197; 09/717,927; and 09/823,948, all of which are expressly incorporated herein in their entirety by reference.

The reactor head 30 can be carried by a lift/rotate apparatus that rotates the reactor head 30 from an upwardly-facing orientation in which it can receive the microelectronic workpiece to a downwardly facing orientation in which the plating surface of the microelectronic workpiece can contact the electroplating solution in reactor base 35. The lift/rotate apparatus can bring the workpiece 25 into contact with the electroplating solution either coplanar or at a given angle. A robotic system, which can include an end effector, is typically employed for loading/unloading the microelectronic workpiece 25 on the head 30. It will be recognized that other reactor assembly configurations may be used with the inventive aspects of the disclosed reactor chamber, the foregoing being merely illustrative.

The reactor base 35 can include an outer overflow container 37 and an interior processing container 39. A flow of electroplating fluid flows into the processing container 39 through an inlet 42 (arrow I). The electroplating fluid flows through the interior of the processing container 39 and overflows a weir 44 at the top of processing container 39 (arrow F). The fluid overflowing the weir 44 then passes through an overflow container 37 and exits the reactor 20 through an outlet 46 (arrow O). The fluid exiting the outlet 46 may be directed to a recirculation system, chemical replenishment system, disposal system, etc.

The reactor 20 also includes an electrode in the processing container 39 to contact the electrochemical processing fluid (e.g., the electroplating fluid) as it flows through the reactor 20. In the embodiment of FIG. 3, the reactor 20 includes an electrode assembly 50 having a base member 52 through which a plurality of fluid flow apertures 54 extend. The fluid flow apertures 54 assist in disbursing the electroplating fluid flow entering inlet 42 so that the flow of electroplating fluid at the surface of microelectronic workpiece 25 is less localized and has a desired radial distribution. The electrode assembly 50 also includes an electrode array 56 that can comprise a plurality of individual electrodes 58 supported by the base member 52. The electrode array 56 can have several configurations, including those in which electrodes are disposed at different distances from the microelectronic workpiece. The particular physical configuration that is utilized in a given reactor can depend on the particular type and shape of the microelectronic workpiece 25. In the illustrated embodiment, the microelectronic workpiece 25 is a disk-shaped semiconductor wafer. Accordingly, the present inventors have found that the individual electrodes 58 may be formed as rings of different diameters and that they may be arranged concentrically in alignment with the center of microelectronic workpiece 25. It will be recognized, however, that grid arrays or other electrode array configurations may also be employed without departing from the scope of the present invention. One suitable configuration of the reactor base 35 and electrode array 56 is disclosed in U.S. Ser. No. 09/804,696, filed Mar. 12, 2001, while another suitable configuration is disclosed in U.S. Ser. No. 09/804,697, filed Mar. 12, 2001, both of which are hereby incorporated by reference.

When the reactor 20 electroplates at least one surface of microelectronic workpiece 25, the plating surface of the workpiece functions as a cathode in the electrochemical reaction and the electrode array 56 functions as an anode. To this end, the plating surface of workpiece 25 is connected to a negative potential terminal of a power supply 60 through contacts 85 and the individual electrodes 58 of the electrode array 56 are connected to positive potential terminals of the supply 60. In the illustrated embodiment, each of the individual electrodes 58 is connected to a discrete terminal of the supply 60 so that the supply 60 may individually set and/or alter one or more electrical parameters, such as the current flow, associated with each of the individual electrodes 58. As such, each of the individual electrodes 58 of FIG. 3 is an individually controllable electrode. It will be recognized, however, that one or more of the individual electrodes 58 of the electrode array 56 may be connected to a common node/terminal of the power supply 60. In such instances, the power supply 60 will alter the one or more electrical parameters of the commonly connected electrodes 58 concurrently, as opposed to individually, thereby effectively making the commonly connected electrodes 58 a single, individually controllable electrode. As such, individually controllable electrodes can be physically distinct electrodes that are connected to discrete terminals of power supply 60 as well as physically distinct electrodes that are commonly connected to a single discrete terminal of power supply 60. The electrode array 56 preferably comprises at least two individually controllable electrodes.

The electrode array 56 and the power supply 60 facilitate localized control of the electrical parameters used to electrochemically process the microelectronic workpiece 25. This localized control of the electrical parameters can be used to enhance the uniformity of the electrochemical processing across the surface of the microelectronic workpiece when compared to a single electrode system. Unfortunately, determining the electrical parameters for each of the electrodes 58 in the array 56 to achieve the desired process uniformity can be difficult. The optimizer, however, simplifies and substantially automates the determination of the electrical parameters associated with each of the individually controllable electrodes. In particular, the optimizer determines a plurality of sensitivity values, either experimentally or through numerical simulation, and subsequently uses the sensitivity values to adjust the electrical parameters associated with each of the individually controllable electrodes. The sensitivity values may be placed in a table or may be in the form of a Jacobian matrix. This table/matrix holds information corresponding to process parameter changes (i.e., thickness of the electroplated film) at various points on the workpiece 25 due to electrical parameter perturbations (i.e., electrical current changes) to each of the individually controllable electrodes. This table/matrix is derived from data from a baseline workpiece plus data from separate runs with a perturbation of a controllable electrical parameter to each of the individually controllable electrode.

The optimizer typically executes in a control system 65 that is connected to the power supply 60 in order to supply current values for a plating cycle. The control system 65 can take a variety of forms, including general- or special-purpose computer systems, either integrated into the manufacturing tool containing the reaction chamber or separate from the manufacturing tool, such as a laptop or other portable computer system. The control system may be communicatively connected to the power supply 60, or may output current values that are in turn manually inputted to the power supply. Where the control system is connected to the power supply by a network, other computer systems and similar devices may intervene between the control system and the power supply. In many embodiments, the control system contains such components as one or more processors, a primary memory for storing programs and data, a persistent memory for persistently storing programs and data, input/output devices, and a computer-readable medium drive, such as a CD-ROM drive or a DVD drive.

Figure 4:
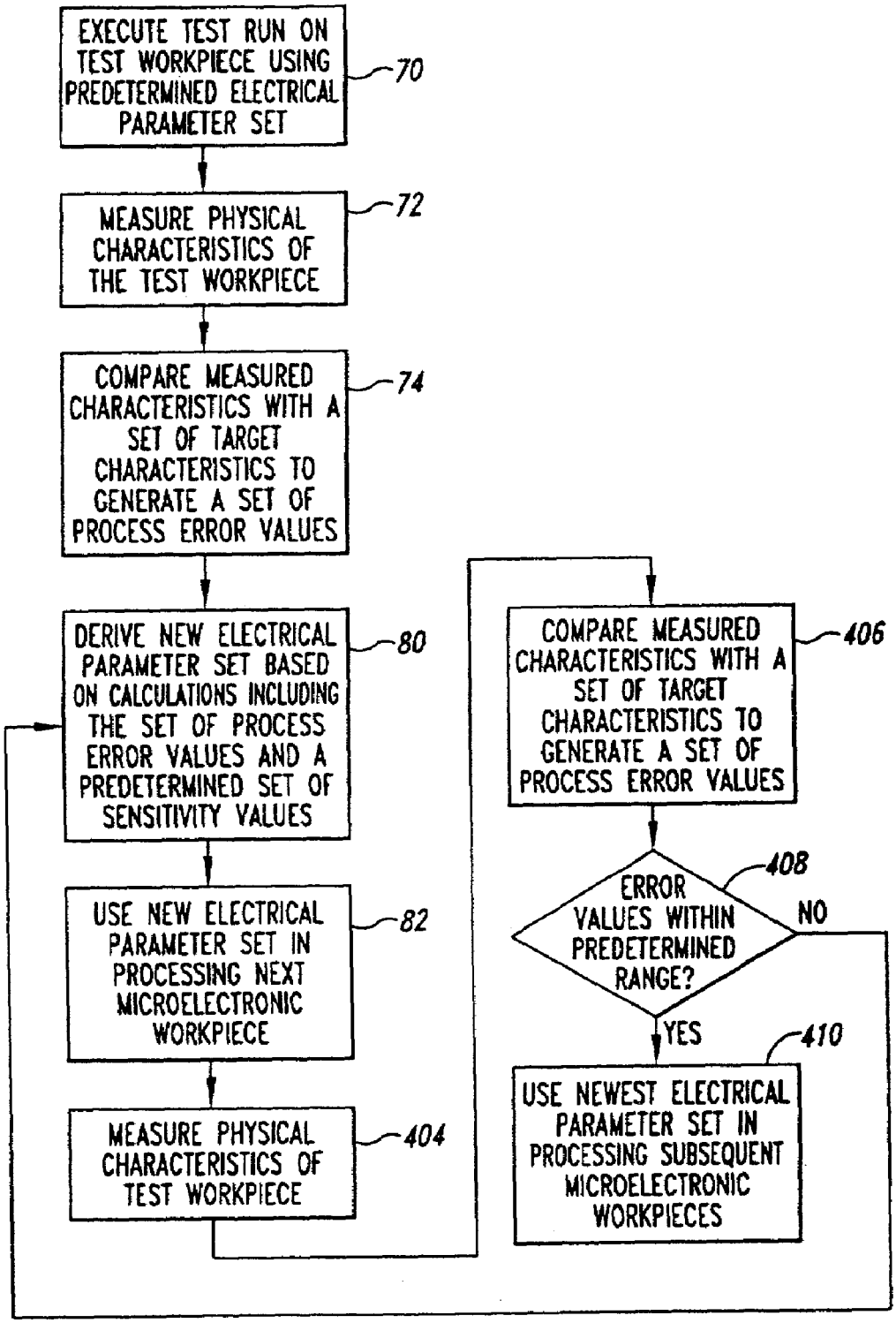
FIG. 4 is a flowchart illustrating one manner in which the optimizer of FIG. 3 can use a predetermined set of sensitivity values to generate a more accurate electrical parameter set for use in meeting targeted physical characteristics in the processing of a microelectronic workpiece.

Once the values for the sensitivity table/matrix have been determined, the values may be stored in and used by control system 65 to control one or more of the electrical parameters that power supply 60 uses in connection with each of the individually controllable electrodes 58. FIG. 4 is a flow diagram illustrating one manner in which the sensitivity table/matrix may be used to calculate an electrical parameter (i.e., current) for each of the individually controllable electrodes 58 that may be used to meet a process target parameter (i.e., target thickness of the electroplated film).

In the steps shown in FIG. 4, the optimizer utilizes two sets of input parameters along with the sensitivity table/matrix to calculate the required electrical parameters. In step 70, the optimizer performs a first plating cycle (a "test run") using a known, predetermined set of electrical parameters. For example, a test run can be performed by subjecting a microelectronic workpiece 25 to an electroplating process in which the current provided to each of the individually controllable electrodes 58 is fixed at a predetermined magnitude for a given period of time.

In step 72, after the test run is complete, the optimizer measures the physical characteristics (i.e., thickness of the electroplated film) of the test workpiece to produce a first set of parameters. For example, in step 72, the test workpiece may be subjected to thickness measurements using a metrology station, producing a set of parameters containing thickness measurements at each of a number of points on the test workpiece. In step 74, the optimizer compares the physical characteristics of the test workpiece measured in step 72 against a second set of input parameters. In the illustrated embodiment of the method, the second set of input parameters corresponds to the target physical characteristics of the microelectronic workpiece that are to be ultimately achieved by the process (i.e., the thickness of the electroplated film). Notably, the target physical characteristics can either be uniform over the surface of the microelectronic workpiece 25 or vary over the surface. For example, in the illustrated embodiment, the thickness of an electroplated film on the surface of the microelectronic workpiece 25 can be used as the target physical characteristic, and the user may expressly specify the target thicknesses at various radial distances from the center of the workpiece, a grid relative to the workpiece, or other reference systems relative to fiducials on the workpiece.

In step 74, the optimizer uses the first and second set of input parameters to generate a set of process error values. In step 80, the optimizer derives a new electrical parameter set based on calculations including the set of process error values and the values of the sensitivity table/matrix. In step 82, once the new electrical parameter set is derived, the optimizer directs power supply 60 to use the derived electrical parameters in processing the next microelectronic workpiece. Then, in step 404, the optimizer measures physical characteristics of the test workpiece in a manner similar to step 72. In step 406, the optimizer compares the characteristics measured in step 404 with a set of target characteristics to generate a set of process error values. The set of target characteristics may be the same set of target characteristics as used in step 74, or may be a different set of target characteristics. In step 408, if the error values generated in step 406 are within a predetermined range, then the optimizer continues in step 410, else the facility continues in 80. In step 80, the optimizer derives a new electrical parameter set. In step 410, the optimizer uses the newest electrical parameter derived in step 80 in processing subsequent microelectronic workpieces. In some embodiments (not shown), the processed microelectronic workpieces, and/or their measured characteristics are examined, either manually or automatically, in order to further troubleshoot the process.

With reference again to FIG. 3, the first and second set of input parameters may be provided to the control system 65 by a user interface 64 and/or a metrics tool 86. The user interface 64 can include a keyboard, a touch-sensitive screen, a voice recognition system, and/or other input devices. The metrics tool 86 may be an automated tool that is used to measure the physical characteristics of the test workpiece after the test run, such as a metrology station.

When both a user interface 64 and a metrics tool 86 are employed, the user interface 64 may be used to input the target physical characteristics that are to be achieved by the process while metrics tool 86 may be used to directly communicate the measured physical characteristics of the test workpiece to the control system 65. In the absence of a metrics tool that can communicate with control system 65, the measured physical characteristics of the test workpiece can be provided to control system 65 through the user interface 64, or by removable data storage media, such as a floppy disk. It will be recognized that the foregoing are only examples of suitable data communications devices and that other data communications devices may be used to provide the first and second set of input parameters to control system 65.

In order to predict change in thickness as a function of change in current, the optimizer generates a Jacobian sensitivity matrix. An example in which the sensitivity matrix generated by the optimizer is based upon a mathematical model of the reaction chamber is discussed below. In additional embodiments, however, the sensitivity matrix used by the optimizer is based upon experimental results produced by operating the actual reaction chamber. The data modeled in the sensitivity matrix includes a baseline film thickness profile and as many perturbation curves as anodes, where each perturbation curve involves adding roughly 0.05 amps to one specific anode. The Jacobian is a matrix of partial derivatives, representing the change in thickness in microns over the change in current in amp minutes. Specifically, the Jacobian is an m×n matrix where m, the number of rows, is equal to the number of radial location data points in the modeled data and n, the number of columns, is equal to the number of anodes on the reactor. Typically, the value of m is relatively large (>100) due to the computational mesh chosen for the model of the chamber. The components of the matrix are calculated by taking the quotient of the difference in thickness due to the perturbed anode and the current change in amp-minutes, which is the product of the current change in amps and the run time in minutes.

As one source of feedback control, the optimizer uses the thickness of the most-recently plated wafer at each of a number of radial positions on the plated wafer. These radial positions may either be selected from the radial positions corresponding to the rows of the matrix, or may be interpolated between the radial positions corresponding to the rows of the matrix. A wide range of numbers of radial positions may be used. As the number of radial positions used increases, the optimizer's results in terms of coating uniformity improves. However, as the number of radial positions used increases, the amount of time required to measure the wafer, to input the measurement results, and/or to operate the optimizer to generate new currents can increase. Accordingly, the smallest number of radial positions that produce acceptable results is typically used. One approach is to use the number of radial test points within a standard metrology contour map (4 for 200 mm and 4 or 6 for 300 mm) plus one, where the extra point is added to better the 3 sigma uniformity for all the points (i.e., to better the diameter scan).

A specific measurement point map may be designed for the metrology station, which will measure the appropriate points on the wafer corresponding with the radial positions necessary for the optimizer operation.

Figure 5:
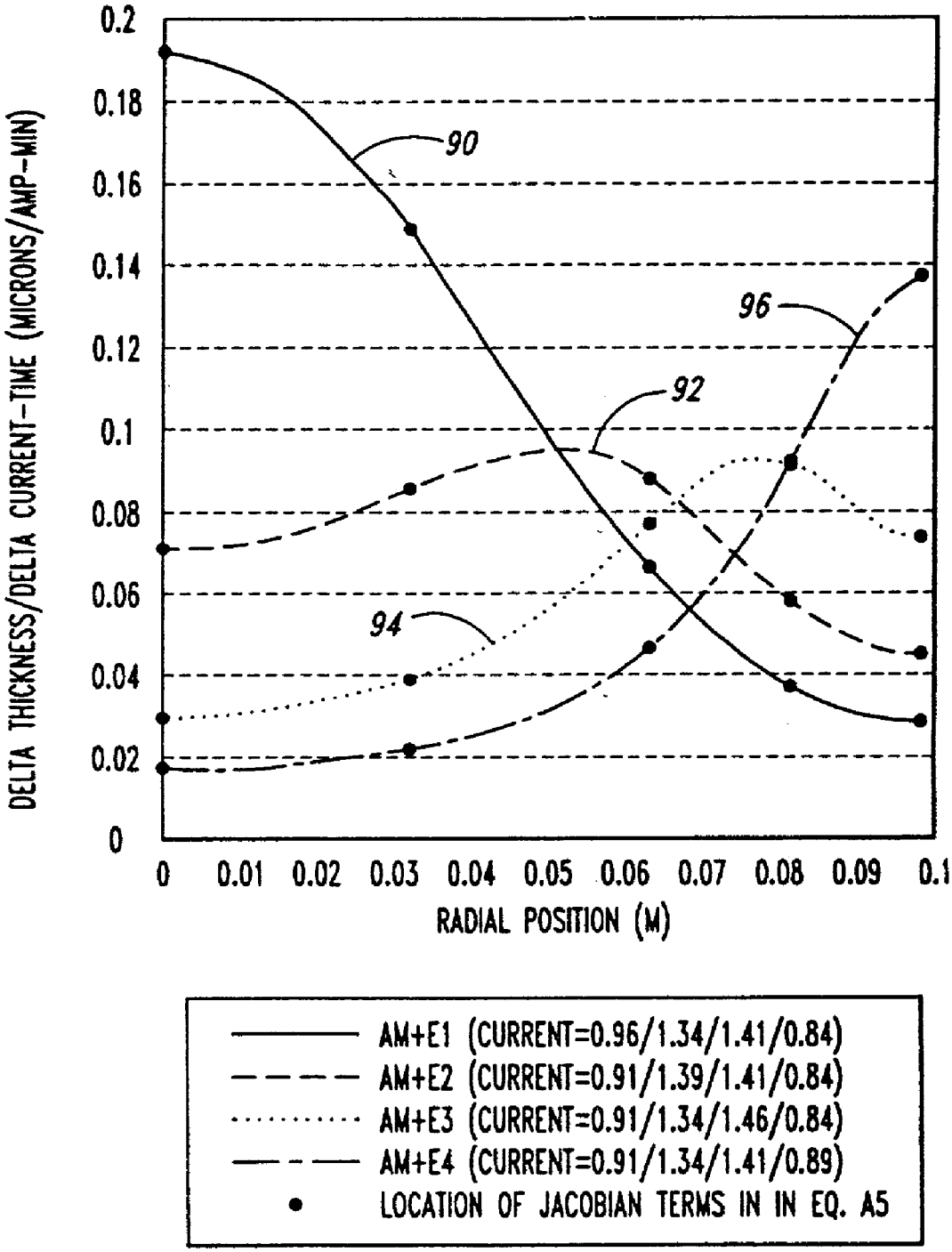
FIG. 5 is a graph of a sample Jacobian sensitivity matrix for a multiple-electrode reaction chamber.

The optimizer can further be understood with reference to a specific embodiment in which the electrochemical process is electroplating, the thickness of the electroplated film is the target physical parameter, and the current provided to each of the individually controlled electrodes 58 is the electrical parameter that is to be controlled to achieve the target film thickness. In accordance with this specific embodiment, a Jacobian sensitivity matrix is first derived from experimental or numerically simulated data. FIG. 5 is a graph of a sample Jacobian sensitivity matrix for a multiple-electrode reaction chamber. In particular, FIG. 5 is a graph of a sample change in electroplated film thickness per change in current-time as a function of radial position on the microelectronic workpiece 25 for each of a number of individually controlled electrodes, such as anodes A1–A4 shown in FIG. 3. A first baseline workpiece is electroplated for a predetermined period of time by delivering a predetermined set of current values to electrodes in the multiple anode reactor. The thickness of the resulting electroplated film is then measured as a function of the radial position on the workpiece. These data points are then used as baseline measurements that are compared to the data acquired as the current to each of the anodes A1–A4 is perturbated. Line 90 is a plot of the Jacobian terms associated with a perturbation in the current provided by power supply 60 to anode A1 with the current to the remaining anodes A2–A4 held at their constant predetermined values. Line 92 is a plot of the Jacobian terms associated with a perturbation in the current provided by power supply 60 to anode A2 with the current to the remaining anodes A1 and A3–A4 held at their constant predetermined values. Line 94 is a plot of the Jacobian terms associated with a perturbation in the current provided by power supply 60 to anode A3 with the current to the remaining anodes A1–A2 and A4 held at their constant predetermined values. Lastly, line 96 is a plot of the Jacobian terms associated with a perturbation in the current provided by power supply 60 to anode A4 with the current to the remaining anodes A1–A3 held at their constant predetermined values.

The data for the Jacobian parameters shown in FIG. 5 may be computed using the following equations:

$$J_{ij} = \frac{\partial t_1}{\partial AM_j} \cong \frac{t_i(AM + \varepsilon_j) - t_1(AM)}{|\varepsilon_j|} \qquad \text{Equation (A1)}$$

$$t(AM)=[t_1(AM)t_2(AM) \ldots t_m(AM)] \qquad \text{Equation (A2)}$$

$$AM[AM_1AM_2 \ldots AM_n] \qquad \text{Equation (A3)}$$

$$\varepsilon_1 = \begin{bmatrix} \Delta AM_1 \\ 0 \\ \cdot \\ \cdot \\ 0 \end{bmatrix} \varepsilon_2 = \begin{bmatrix} 0 \\ \Delta AM_2 \\ 0 \\ \cdot \\ 0 \end{bmatrix} \ldots \varepsilon_n = \begin{bmatrix} 0 \\ \cdot \\ \cdot \\ 0 \\ \Delta AM_n \end{bmatrix} \qquad \text{Equation (A4)}$$

where:

t represents thickness [microns];

AM represents current [amp-minutes];

ϵ represents perturbation [amp-minutes];

i is an integer corresponding to a radial position on the workpiece;

j is an integer representing a particular anode;

m is an integer corresponding to the total number of radial positions on the workpiece; and n is an integer representing the total number of individually-controllable anodes.

The Jacobian sensitivity matrix, set forth below as Equation (A5), is an index of the Jacobian values computed using Equations (A1)–(A4). The Jacobian matrix may be generated either using a simulation of the operation of the deposition chamber based upon a mathematical model of the deposition chamber, or using experimental data derived from the plating of one or more test wafers. Construction of such a mathematical model, as well as its use to simulate operation of the modeled deposition chamber, is discussed in detail in G. Ritter, P. McHugh, G. Wilson and T. Ritzdorf, "Two- and three- dimensional numerical modeling of copper electroplating for advanced ULSI metallization," Solid State Electronics, volume 44, issue 5, pp. 797–807 (May 2000), available from http://www.elsevier.nl/gej-ng/10/30/25/29/28/27/article.pdf, also available from http://journals.ohiolink.edu/pdflinks/01040215463800982.pdf.

$$J = \begin{vmatrix} 0.192982 & 0.071570 & 0.030913 & 0.017811 \\ 0.148448 & 0.084824 & 0.039650 & 0.022264 \\ 0.066126 & 0.087475 & 0.076612 & 0.047073 \\ 0.037112 & 0.057654 & 0.090725 & 0.092239 \\ 0.029689 & 0.045725 & 0.073924 & 0.138040 \end{vmatrix} \quad \text{Equation (A5)}$$

The values in the Jacobian matrix are also presented as highlighted data points in the graph of FIG. 5. These values correspond to the radial positions on the surface of a semiconductor wafer that are typically chosen for measurement. Once the values for the Jacobian sensitivity matrix have been derived, they may be stored in control system 65 for further use.

Table 1 below sets forth exemplary data corresponding to a test run in which a 200 mm wafer is plated with copper in a multiple anode system using a nominally 2000 Å thick initial copper seed-layer. Identical currents of 1.12 Amps (for 3 minutes) were provided to all four anodes A1–A4. The resulting thickness at five radial locations was then measured and is recorded in the second column of Table 1. The 3 sigma uniformity of the wafer is 9.4% using a 49 point contour map. Target thickness were then provided and are set forth in column 3 of Table 1. In this example, because a flat coating is desired, the target thickness is the same at each radial position. The thickness errors (processed errors) between the plated film and the target thickness were then calculated and are provided in the last column of Table 1. These calculated thickness errors are used by the optimizer as a source of feedback control.

TABLE 1

DATA FROM WAFER PLATED WITH 1.12 AMPS TO EACH ANODE.

| Radial Location (m) | Measured Thickness (microns) | Target Thickness (microns) | Error (microns) |
|---|---|---|---|
| 0 | 1.1081 | 1.0291 | −0.0790 |
| 0.032 | 1.0778 | 1.0291 | −0.0487 |
| 0.063 | 1.0226 | 1.0291 | 0.0065 |
| 0.081 | 1.0169 | 1.0291 | 0.0122 |
| 0.098 | 0.09987 | 1.0291 | 0.0304 |

The Jacobian sensitivity matrix may then be used along with the thickness error values to provide a revised set of anode current values that should yield better film uniformity. The equations summarizing this approach are set forth below:

$$\Delta AM = J^{-1}\Delta t \quad \text{Equation (B1)}$$

(for a square system in which the number of measured radial positions corresponds to the number of individually controlled anodes in the system); and $$\Delta AM = (J^T J)^{-1} J^T \Delta t \quad \text{Equation (B2)}$$

(for a non-square system in which the number of measured radial positions is different than the number of individually controlled anodes in the system).

$$\Delta t_1 = t_1^{target} - t_1^{old} - (t_1^{newseed} - t_1^{oldseed}) + t_1^{specified} \quad \text{Equation (B3)}$$

In Equation (B3), $t_1^{target}$ is the target thickness required to obtain a wafer of desired profile while considering the total current adjustment, $t_1^{old}$ is the old overall thickness, $t_1^{newseed}$ is the thickness of the new seed layer, $t_1^{oldseed}$ is the thickness of the old seed layer, and $t_1^{specified}$ is the thickness specification relative to the center of the wafer, that is, the thickness specified by the target plating profile. In particular, the term $t_1^{specified}$ represents the target thickness, while the quantity $t_1^{target}-t_1^{old}$ represents feedback from the previous wafer, and the quantity $t_1^{newseed}-t_1^{old\ seed}$ represents feedforward from the thickness of the seed layer of the incoming wafer—to disable feedback control, the first quantity is omitted from equation (B3); to disable feedforward control, the second quantity is omitted from equation (B3).

Table 2 shows the foregoing equations as applied to the given data set and the corresponding current changes that have been derived from the equations to meet the target thickness at each radial location (best least square fit). Such application of the equations, and construction of the Jacobian matrix is in some embodiments performed using a spreadsheet application program, such as Microsoft Excel®, in connection with specialized macro programs. In other embodiments, different approaches are used in constructing the Jacobian matrix and applying the above equations.

The wafer uniformity obtained with the currents in the last column of Table 2 was 1.7% (compared to 9.4% for the test run wafer). This procedure can be repeated again to try to further improve the uniformity. In this example, the differences between the seed layers were ignored since the seed layers are substantially the same.

TABLE 2

CURRENT ADJUSTMENT

| Anode # | Anode Currents for Run #1 (Amps) | Change to Anode Currents (Amps) | Anode Currents for Run #2 (Amps) |
|---|---|---|---|
| 1 | 1.12 | −0.21 | 0.91 |
| 2 | 1.12 | 0.20 | 1.32 |
| 3 | 1.12 | −0.09 | 1.03 |
| 4 | 1.12 | 0.10 | 1.22 |

Once the corrected values for the anode currents have been calculated, control system 65 of FIG. 3 directs power supply 60 to provide the corrected current to the respective anode A1–A4 during subsequent processes to meet the target film thickness and uniformity.

In some instances, it may be desirable to iteratively apply the foregoing equations to arrive at a set of current change values (the values shown in column 3 of Table 2) that add up to zero. For example, doing so enables the total plating charge—and therefore the total mass of plated material—to be held constant without having to vary the recipe time.

The Jacobian sensitivity matrix in the foregoing example quantifies the system response to anode current changes about a baseline condition. Ideally, a different matrix may be employed if the processing conditions vary significantly from the baseline. The number of system parameters that may influence the sensitivity values of the sensitivity matrix is quite large. Such system parameters include the seed layer thickness, the electrolyte conductivity, the metal being plated, the film thickness, the plating rate, the contact ring geometry, the wafer position relative to the chamber, and the anode shape/current distribution. Anode shape/current distribution is included to accommodate chamber designs where changes in the shape of consumable anodes over time affect plating characteristics of the chamber. Changes to all of these items can change the current density across the wafer for a given set of anode currents and, as a result, can change the response of the system to changes in the anode currents. It is expected, however, that small changes to many of these parameters will not require the calculation of a new sensitivity matrix. Nevertheless, a plurality of sensitivity tables/matrices may be derived for different processing conditions and stored in control system 65. Which of the sensitivity tables/matrices is to be used by the control system 65 can be entered manually by a user, or can be set automatically depending on measurements taken by certain sensors or the like (i.e., temperature sensors, chemical analysis units, etc.) that indicate the existence of one or more particular processing conditions.

The optimizer may also be used to compensate for differences and non-uniformities of the initial seed layer of the microelectronic workpiece. Generally stated, a blanket seed layer can affect the uniformity of a plated film in two ways:

1. If the seed layer non-uniformity changes, this non-uniformity is added to the final film. For example, if the seed layer is 100 Å thinner at the outer edge than expected, the final film thickness may also be 100 Å thinner at the outer edge.

2. If the average seed-layer thickness changes significantly, the resistance of the seed-layer will change resulting in a modified current density distribution across the wafer and altered film uniformity. For example, if the seed layer decreases from 2000 Å to 1000 Å, the final film will not only be thinner (because the initial film is thinner) but it will also be relatively thicker at the outer edge due to the higher resistivity of the 1000 Å seed-layer compared to the 2000 Å seed-layer (assuming an edge contact).

The optimizer can be used to compensate for such seed-layer deviations, thereby utilizing seed-layer thicknesses as a source of feed-forward control. In the first case above, the changes in seed-layer uniformity may be handled in the same manner that errors between target thickness and measured thickness are handled. A pre-measurement of the wafer quantifies changes in the seed-layer thickness at the various radial measurement locations and these changes (errors) are figured into the current adjustment calculations. Using this approach, excellent uniformity results can be obtained on the new seed layer, even on the first attempt at electroplating.

In the second case noted above, an update of or selection of another stored sensitivity/Jacobian matrix can be used to account for a significantly different resistance of the seed-layer. A simple method to adjust for the new seed layer thickness is to plate a film onto the new seed layer using the same currents used in plating a film on the previous seed layer. The thickness errors measured from this wafer can be used with a sensitivity matrix appropriate for the new seed-layer to adjust the currents.

To further illuminate the operation of the optimizer, a second test run is described. In the second test run, the optimization process begins with a baseline current set or standard recipe currents. A wafer must be pre-read for seed layer thickness data, and then plated using the indicated currents. After plating, the wafer is re-measured for the final thickness values. The following wafer must also be pre-read for seed layer thickness data. Sixty-seven points at the standard five radial positions (0 mm, 31.83 mm, 63.67 mm, 80 mm, 95.5 mm) are typically measured and averaged for each wafer reading.

The thickness data from the previous wafer, and the new wafer seed layer, in addition to the anode currents, are entered into the input page of the optimizer. The user may also elect to input a thickness specification, or chose to modify the plating thickness by adjusting the total current in amp-minutes. After all the data is correctly inputted, the user activates the optimizer. In response, the optimizer predicts thickness changes and calculates new currents.

The new wafer is then plated with the adjusted anode currents and then measured. A second modification may be required if the thickness profile is not satisfactory.

When a further iteration is required, the optimization is continued. As before, the post-plated wafer is measured for thickness values, and another wafer is pre-read for a new seed set of seed layer thickness values. Then, the following quantities are entered on the input page:

1. plated wafer thickness,
2. anode currents,
3. plated wafer seed layer thickness, and
4. new wafer seed layer thickness The recipe time and thickness profile specification should be consistent with the previous iteration. The program is now ready to be run again to provide a new set of anode currents for the next plating attempt.

After plating with the new currents, the processed wafer is measured and if the uniformity is still not acceptable, the procedure may be continued with another iteration. The standard value determining the uniformity of a wafer is the 3σ, which is the standard deviation of the measured points relative to the mean and multiplied by three. Usually a forty-nine point map is used with measurements at the radial positions of approximately 0 mm, 32 mm, 64 mm, and 95 mm to test for uniformity.

The above procedure will be demonstrated using a multi-iteration example. Wafer #3934 is the first plated wafer using a set of standard anode currents: 0.557/0.818/1.039/0.786 (anode1/anode2/anode3/anode4 in amps) with a recipe time of 2.33 minutes (140 seconds). Before plating, the wafer is pre-read for seed layer data. These thickness values, in microns, from the center to the outer edge, are shown in Table 3:

TABLE 3

SEED LAYER THICKNESS VALUES FOR WAFER #3934

| Radius (mm) | Thickness (μm) |
|---|---|
| 0.00 | 0.130207 |
| 31.83 | 0.13108 |
| 63.67 | 0.131882 |
| 80.00 | 0.129958 |
| 95.50 | 0.127886 |

The wafer is then sent to the plating chamber, and then re-measured after being processed. The resulting thickness values (in microns) for the post-plated wafer #3934 are shown in Table 4:

TABLE 4

| THICKNESS VALUES FOR POST-PLATED WAFER #3934 | |
|---|---|
| Radius (mm) | Thickness (μm) |
| 0.00 | 0.615938 |
| 31.83 | 0.617442 |
| 63.67 | 0.626134 |
| 80.00 | 0.626202 |
| 95.50 | 0.628257 |

The 3-σ for the plated wafer is calculated to be 2.67% over a range of 230.4 Angstroms. Since the currents are already producing a wafer below 3%, any adjustments are going to be minor. The subsequent wafer has to be pre-read for seed layer values in order to compensate for any seed layer differences. Wafer #4004 is measured and the thickness values in microns are shown in Table 5:

TABLE 5

| SEED LAYER THICKNESS VALUES FOR WAFER #4004 | |
|---|---|
| Radius (mm) | Thickness (μm) |
| 0.00 | 0.130308 |
| 31.83 | 0.131178 |
| 63.67 | 0.132068 |
| 80.00 | 0.13079 |
| 95.50 | 0.130314 |

Figure 6:
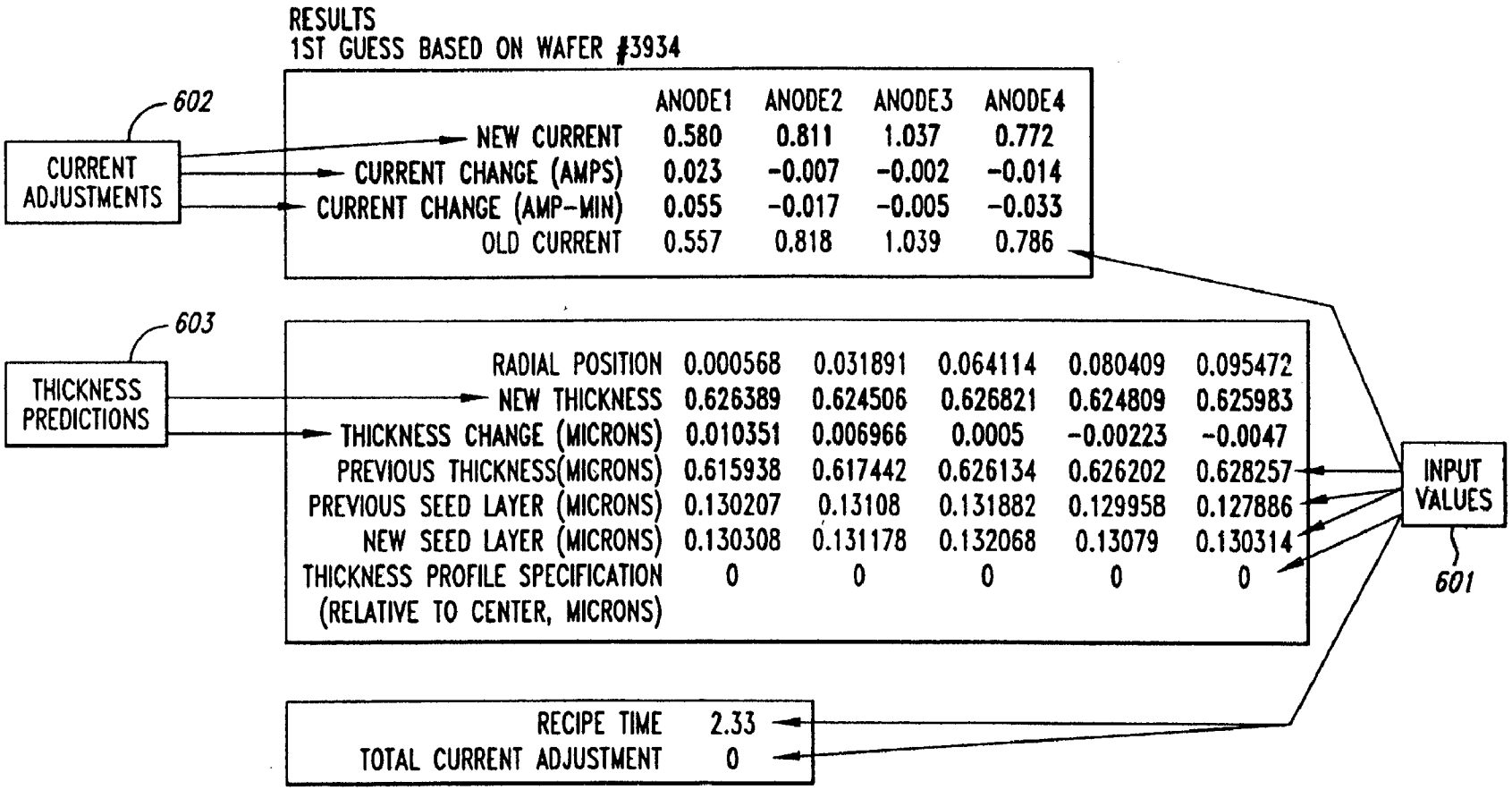
FIG. 6 is a spreadsheet diagram showing the new current outputs calculated from the inputs for the first optimization run.

For this optimization run, there is no thickness profile specification, or overall thickness adjustment. All of the preceding data is inputted into the optimizer, and the optimizer is activated to generate a new set of currents. These currents will be used to plate the next wafer. FIG. 6 is a spreadsheet diagram showing the new current outputs calculated from the inputs for the first optimization run. It can be seen that the input values 601 have generated output 602, including a new current set. The optimizer has also predicted the absolute end changed thicknesses 603 that this new current set will produce.

The new anode currents are sent to the process recipe and run in the plating chamber. The run time and total currents (amp-minutes) remain constant, and the current density on the wafer is unchanged. The new seed layer data from this run for wafer #4004 will become the old seed layer data for the next iteration.

The thickness (microns) resulting from the adjusted currents plated on wafer #4004 are shown in Table 6:

TABLE 6

| THICKNESS VALUES FOR POST-PLATED WAFER #4004 | |
|---|---|
| Radius (mm) | Thickness (μm) |
| 0.00 | 0.624351 |
| 31.83 | 0.621553 |
| 63.67 | 0.622704 |
| 80.00 | 0.62076 |
| 95.50 | 0.618746 |

The post-plated wafer has a 3-σ of 2.117% over a range of 248.6 Angstroms. To do another iteration, a new seed layer measurement is required, unless notified that the batch of wafers has equivalent seed layers. Wafer # 4220 is pre-measured and the thickness values in microns are shown in Table 7:

TABLE 7

| SEED LAYER THICKNESS VALUES FOR WAFER #4220 | |
|---|---|
| Radius (mm) | Thickness (μm) |
| 0.00 | 0.127869 |
| 31.83 | 0.129744 |
| 63.67 | 0.133403 |
| 80.00 | 0.134055 |
| 95.50 | 0.1335560 |

Figure 7:
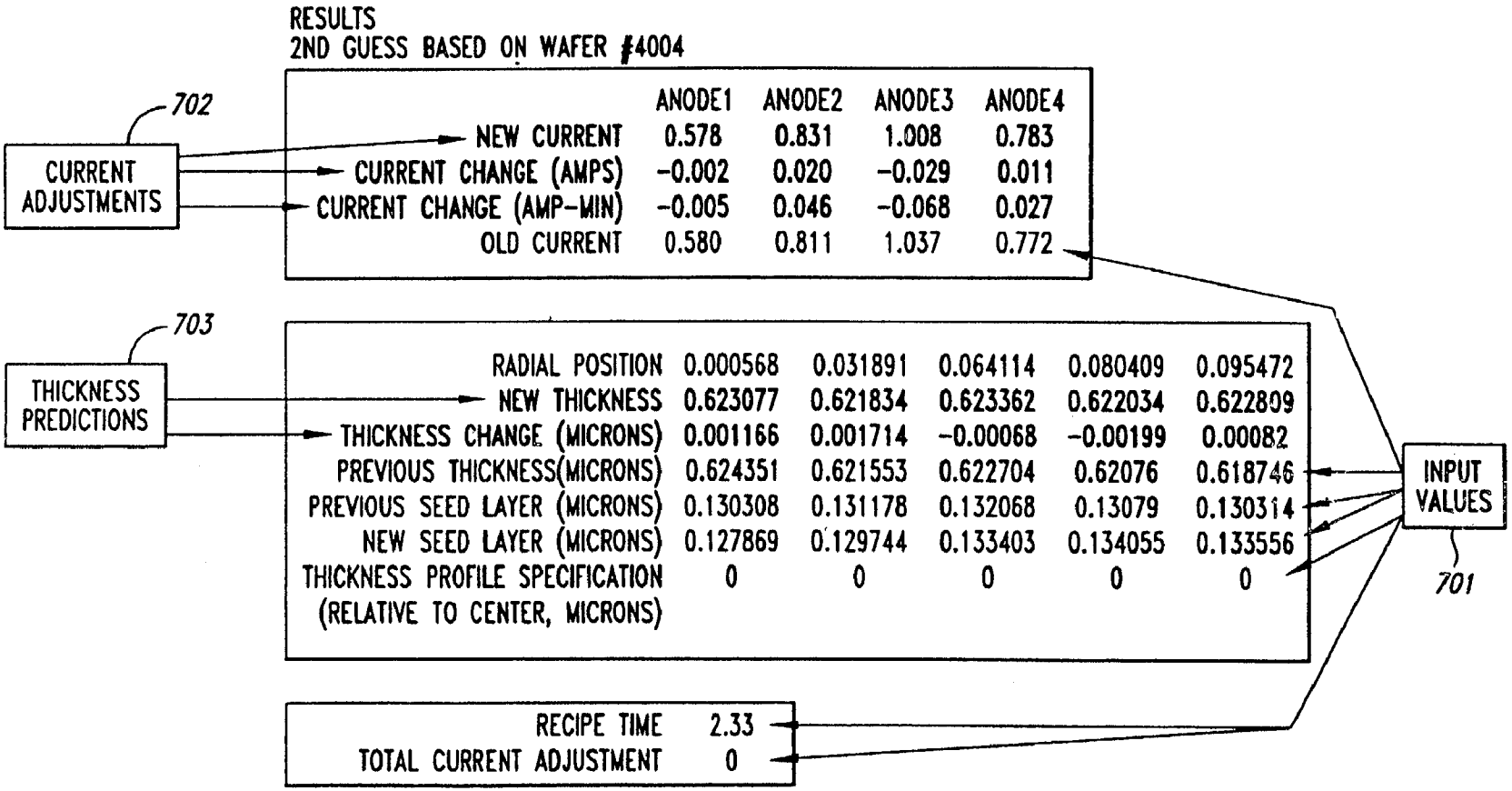
FIG. 7 is a spreadsheet diagram showing the new current outputs calculated from the inputs for the second optimization run.

Again, all of the new data is inputted into the optimizer, along with the currents used to plate the new wafer and the thickness of the plated wafer's seed. The optimizer automatically transfers the new currents into the old currents among the inputs. The optimizer is then activated to generate a new set of currents. FIG. 7 is a spreadsheet diagram showing the new current outputs calculated from the inputs for the second optimization run. It can be seen that, from input value 701, the optimizer has produced output 702 including a new current set. It can further be seen that that the facility has predicted absolute and changed thicknesses 703 that will be produced using the new currents.

The corrected anode currents are again sent to the recipe and applied to the plating process. The $2^{nd}$ adjustments on the anode currents produce the thickness values in microns shown in Table 8:

TABLE 8

| THICKNESS VALUES FOR POST-PLATED WAFER #4220 | |
|---|---|
| Radius (mm) | Thickness (μm) |
| 0.00 | 0.624165 |
| 31.83 | 0.622783 |
| 63.67 | 0.626911 |
| 80.00 | 0.627005 |
| 95.50 | 0.623823 |

The 3-σ for wafer #4220 is 1.97% over a range of 213.6 Angstroms. The procedure may continue to better the uniformity, but the for the purpose of this explanation, a 3-σ below 2% is acceptable.

The optimizer may also be used to compensate for reactor-to-reactor variations in a multiple reactor system, such as the LT-210 C™ available from Semitool, Inc., of Kalispell, Mont. In such a system, there is a possibility that the anode currents required to plate a specified film might be different on one reactor when compared to another. Some possible sources for such differences include variations in the wafer position due to tolerances in the lift-rotate mechanism, variations in the current provided to each anode due to power supply manufacturing tolerances, variations in the chamber geometry due to manufacturing tolerances, variations in the plating solution, etc.

In a single anode system, the reactor-to-reactor variation is typically reduced either by reducing hardware manufacturing tolerances or by making slight hardware modifications to each reactor to compensate for reactor variations. In a multiple anode reactor constructed in accordance with the teachings of the present invention, reactor-to-reactor variations can be reduced/eliminated by running slightly different current sets in each reactor. As long as the reactor variations do not fundamentally change the system response (i.e., the sensitivity matrix), the self-tuning scheme disclosed herein is expected to find anode currents that meet film thickness targets. Reactor-to-reactor variations can be quantified by comparing differences in the final anode currents for each chamber. These differences can be saved in one or more offset tables in the control system 65 so that the same recipe may be utilized in each reactor. In addition, these offset tables may be used to increase the efficiency of entering new processing recipes into the control system 65. Furthermore, these findings can be used to trouble-shoot reactor set up. For example, if the values in the offset table are over a particular threshold, the deviation may indicate a hardware deficiency that needs to be corrected.

As mentioned above, embodiments of the optimizer may be used to set currents and other parameters for complex deposition recipes that specify changes in current during the deposition cycle. As an example, embodiments of the optimizer may be used to determine anode currents in accordance with recipe having two different steps. Step 1 of the recipe lasts for 0.5 minutes, during which a total of +1 amp of current is delivered through four electrodes. Step 2 of the recipe, which immediately follows step 1, is 1.25 minutes long. During step 2, a total current of +9 amps is delivered for 95 milliseconds. Immediately afterwards, a total current of −4.3 amps is delivered for 25 milliseconds. Ten milliseconds after delivery of the −4.3 amp current is concluded, the cycle repeats, delivering +9 amps for another 95 milliseconds. The period during which a positive current is being delivered is known as the "forward phase" of the step, while the time during which a negative current is being delivered is known as the "backward phase" of the step. Backward phases may be used, for example, to reduce irregularities formed in the plated surface as the result of organic substances within the plating solution.

In order to apply the optimizer to optimize currents for this recipe, initial currents are chosen in accordance with the recipe. These are shown below in Table 9.

TABLE 9

Initial Multi-step Recipe

| | | Step 1 | Step 2 |
|---|---|---|---|
| 1. | time | 0.5 | 1.25 |
| 2. | forward fraction | 1 | 0.730769 |
| 3. | anode 1 current | 0.2 | 1.8 |
| 4. | anode 2 current | 0.24 | 2.16 |
| 5. | anode 3 current | 0.34 | 3.06 |
| 6. | anode 4 current | 0.22 | 1.98 |
| 7. | backward fraction | | 0.192307 |
| 8. | anode 1 current | | −0.86 |
| 9. | anode 2 current | | −1.03 |
| 10. | anode 3 current | | −1.46 |
| 11. | anode 4 current | | −0.95 |
| 12. | forward amp-min | 0.5 | 8.221153 |
| 13. | backward amp-min | 0 | −1.033653 |
| 14. | Total Amp-min | | 7.6875 |

The left-hand column of Table 9 shows currents and other information for the first step of the recipe, while the right-hand column shows currents and other information for the second step of the recipe. In line 1, it can be seen that step 1 has a duration of 0.5 minutes, while step 2 has a duration of 1.25 minutes. In line 2, it can be seen that, in step 1, forward plating is performed for 100% of the duration of the step, while in step 2, forward plating is performed for about 73% of the duration of the step (95 milliseconds out of the 130 millisecond period of the step). Lines 3–6 show the currents delivered through each of the anodes during the forward phase of each of the two steps. For example, it can be seen that 0.24 amps are delivered through anode 2 for the duration of step 1. In line 7, it can be seen that a negative current is delivered for about 19% of the duration of step 2 (25 milliseconds out of the total period of 130 milliseconds). Lines 8–11 show the negative currents delivered during the backward phase of step 2. Line 12 shows the charge, in amp-minutes, delivered in the forward phase of each step. For step 1, this is 0.5 amp-minutes, computed by multiplying the step 1 duration of 0.5 minutes by the forward fraction of 1, and by the sum of step 1 forward currents, 1 amp. The forward plating charge for step 2 is about 8.22 amp-minutes, computed by multiplying the duration of step 2, 1.25 minutes, by the forward fraction of about 73%, and by the sum of the forward currents in step 2, 9 amps. Line 13 shows the results of a similar calculation for the backward phase of step 2. Line 14 shows the net plating charge, 7.6875 amp-minutes obtained by summing the signed charge values on lines 12 and 13.

The deposition chamber is used to deposit a wafer in accordance with these initial currents. That is, during the first half-minute of deposition (step 1), +0.2 amps are delivered through anode 1. During the next 1.25 minutes of the process (step 2), +1.8 amps are delivered through anode 1 for 95 milliseconds, then −0.86 amps are delivered through anode 1 for 25 milliseconds, then no current flows through 1 for 10 milliseconds, and then the cycle is repeated until the end of the 1.25 minute duration of step 2. Overall, the charge of 1.537 amp-minutes is delivered through anode 1. This value is determined by multiplying duration, forward fraction, and anode 1 current from step 1, then adding the product of the duration of step 2, the forward fraction of step 2, and the forward anode 1 current of step 2, then adding the product of the duration of step 2, the backward fraction of step 2, and the backward anode 1 current of step 2. Such net plating charges may be calculated for each of the anodes, as shown below in Table 10.

TABLE 10

Net Plating Charges in Initial Multi-step Recipe

| | |
|---|---|
| Anode 1 | 1.537 Amp-min |
| Anode 2 | 1.845 Amp-min |
| Anode 3 | 2.614 Amp-min |
| Anode 4 | 1.690 Amp-min |

These plating charge values are submitted to the optimizer together with thicknesses measured from the wafer plated using the initial current. In response, the optimizer generates a set of new net plating charges for each electrode. These new net plating charges are shown below in Table 11.

TABLE 11

New Net Plating Charges for Revised Recipe

| | |
|---|---|
| Anode 1 | 1.537 Amp-min + 0.171286 Amp-min = 1.709 Amp-min |
| Anode 2 | 1.845 Amp-min − 0.46657 Amp-min = 1.379 Amp-min |
| Anode 3 | 2.614 Amp-min + 0.106337 Amp-min = 1.271 Amp-min |
| Anode 4 | 1.690 Amp-min + 0.188942 Amp-min = 1.879 Amp-min |

The optimizer then computes for each anode a share of the current to be delivered through the anode by dividing the new net plating charge determined for the anode by the sum of the net plating charges determined for all of the anodes. These current shares are shown below in Table 12.

TABLE 12

| Current Shares for Revised Recipe | |
|---|---|
| Anode 1 | 1.709/7.6875 = 22.2% |
| Anode 2 | 1.379/7.6875 = 17.9% |
| Anode 3 | 1.271/7.6875 = 35.5% |
| Anode 4 | 1.879/7.6875 = 24.4% |

The optimizer then determines a new current for each anode in each step and phase of the recipe by multiplying the total current for the step and phase by the current share computed for each anode. These are shown in Table 13 below.

TABLE 13

Revised Multi-Step Recipe

| | | Step 1 | Step 2 |
|---|---|---|---|
| 1. | time | 0.5 | 1.25 |
| 2. | forward fraction | 1 | 0.730769 |
| 3. | anode 1 current | 0.222281 | 2.000530 |
| 4. | anode 2 current | 0.179371 | 1.614339 |
| 5. | anode 3 current | 0.353895 | 3.185055 |
| 6. | anode 4 current | 0.244452 | 2.200075 |
| 7. | backward fraction | | 0.192307 |
| 8. | anode 1 current | 0 | −0.955808 |
| 9. | anode 2 current | 0 | −0.771295 |
| 10. | anode 3 current | 0 | −1.521748 |
| 11. | anode 4 current | 0 | −1.051147 |
| 12. | forward amp-min | 0.5 | 8.221153 |
| 13. | backward amp-min | 0 | −1.033653 |
| 14. | Total Amp-min | 7.6875 | |

For example, it can be seen in line 4 of Table 13 that the forward anode 2 current for step 2 is about 1.61 amps, computed by multiplying the +9 amps total current for the forward phase of step 2 by the current share of 17.9% computed for anode 2 shown in Table 12.

By comparing Table 13 to Table 9, it can be seen that the net plating charge changes specified by the optimizer for the revised recipe are distributed evenly across the steps and phases of this recipe. It can also be seen that the total plating charge for each step and phase of the revised recipe, as well as the total plating charge, is unchanged from the initial multistep recipe. The optimizer may utilize various other schemes for distributing plating charge changes within the recipe. For example, it may alternatively distribute all the changes to step 2 of the recipe, leaving step 1 of the recipe unchanged from the initial multi-step recipe. In some embodiments, the optimizer maintains and applies a different sensitivity matrix for each step in a multi-step recipe.

In some embodiments, the facility utilizes a form of predictive control feedback. In these embodiments, the optimizer generates, for each set of revised currents, a set of predicted plating thicknesses. The optimizer determines the difference between these predicted thicknesses and the actual plated thicknesses of the corresponding workpiece. For each workpiece, this set of differences represents the level of error produced by the optimizer in setting currents for the workpiece. The optimizer uses the set of differences for the previous workpiece to improve performance on the incoming workpiece by subtracting these differences from the target thickness changes to be effected by current changes for the incoming workpiece. In this way, the optimizer is able to more quickly achieve the target plating profile.

Further sample wafer processing processes employing the optimizer are discussed below. It should be noted that no attempt is made to exhaustively list such processes, and that those included are merely exemplary.

Table 13 below shows a sample wafer processing process employing the optimizer, from which a subset of the steps may be selected and/or modified to define additional such processes.

TABLE 13

Sample Wafer Processing Process Employing Optimizer

| Step | Tool/Process |
|---|---|
| 1. | Deposit metal seed layer using one or more physical vapor deposition ("PVD") tools, different chambers on the same PVD tool, or CVD chambers or electroless deposition chambers. |
| 2. | Measure seed layer film thickness using metrology station, either on the tool or an independent station - metrology stations can infer film thickness from sheet resistance measurements or from optical measurements of the film |
| 3. | Apply optimizer - residing on tool or off tool on a personal computer - in a seed layer enhancement ("SLE") chamber using measurements from step 2 (feedforward) and measurement results from previous SLE wafer on step 6 or 8 (feedback) |
| 4. | Deposit metal layer in SLE chamber |
| 5. | Rinse wafer in SRD/Capsule chamber |
| 6. | Measure wafer thickness using Metrology Station |
| 7. | Anneal wafer in annealing chamber on the tool or in independent stations |
| 8. | Measure wafer thickness using Metrology Station |
| 9. | Apply optimizer in ECD chamber using measurements from step 7 (feedforward) and measurement results from previous ECD wafer on step 12 or 14 (feedback) |
| 10. | Deposit final metal layer in ECD chamber |
| 11. | Clean and bevel etch wafer in Capsule chamber |
| 12. | Measure wafer thickness using Metrology Station |
| 13. | Anneal wafer in anneal chamber |
| 14. | Measure wafer thickness using Metrology Station |

These steps may be qualified in a variety of ways including: the measurement/optimizer sequence steps can be performed during tool qualification or "dial-in"; the measurement/optimizer sequence steps sequence can be performed periodically to monitor performance; the measurement/optimizer sequence steps sequence can be performed on each wafer; SLE process may be optional depending upon the measurement results in step 2 (i.e., this wafer may routed around this and associated process steps); wafer sequence may be terminated, rerouted, or restarted based upon the measurement results of step 2, 6, 8, 12, and 14; measurement/optimizer steps may be performed only after process/hardware changes; measurements before and after annealing (e.g., sheet resistance) may be used to determine effectiveness of annealing process; metal deposition steps 4 and 10 may be deposition of same metals or different metals—they could deposit the same metal using different baths; one or more metal deposition steps could be used, which deposit one or more different metals; the optimization steps may adjust currents to generate a flat thickness profile or one with a specified shape; the optimization steps may adjust current to generate a desired current density profile for future filling; the wafer may be returned to a deposition chamber for additional metal deposition if the film thickness is insufficient, based upon metrology results.

Table 14 below shows an additional sample process:

TABLE 14

Sample Wafer Processing Process Employing Optimizer

| Step | Tool/Process |
|---|---|
| 1. | Deposit metal seed layer using PVD tool |
| 2. | Measure seed layer film thickness using metrology station |
| 3. | Apply optimizer in ECD chamber using measurements from step 2 (feedforward) and measurement results from previous ECD wafer on step 7 (feedback) |
| 4. | Deposit final metal layer in ECD chamber |
| 5. | Anneal wafer in anneal chamber |
| 6. | Clean and bevel etch wafer in Capsule chamber |
| 7. | Measure wafer thickness using Metrology Station |

TABLE 15

Sample Wafer Processing Process Employing Optimizer

| Step | Tool/Process |
|---|---|
| 1. | Deposit metal seed layer using PVD tool |
| 2. | Measure seed layer film thickness using metrology station |
| 3. | Apply optimizer in ECD chamber using measurements from step 2 (feedforward) and measurement results from previous ECD wafer on step 6 (feedback) |
| 4. | Deposit final metal layer in ECD chamber |
| 6. | Clean and bevel etch wafer in Capsule chamber |
| 7. | Measure wafer thickness using Metrology Station |

Table 16 below shows an additional sample process:

TABLE 16

Sample Wafer Processing Process Employing Optimizer

| Step | Tool/Process |
|---|---|
| 1. | Deposit metal seed layer using PVD tool |
| 2. | Measure seed layer film thickness using metrology station |
| 3. | Apply optimizer in ECD chamber using measurements from step 2 (feedforward) and measurement results from previous SLE wafer on step 6 (feedback) |
| 4. | Deposit metal layer in SLE chamber |
| 6. | Clean and bevel etch wafer in Capsule chamber |
| 7. | Measure wafer thickness using Metrology Station |

As an additional sample process, the thickness uniformity of a wafer with a PVD-deposited seed layer is measured on a dedicated metrology tool, after which the wafer is brought to the plating tool and placed in an SLE process chamber. Using the measurements from the dedicated metrology tool, the optimizer is used to select an SLE recipe that will augment the PVD-deposited seed layer to yield a seed layer with improved thickness uniformity, and the SLE process is performed on the wafer. After the wafer has been cleaned and dried in one of the plating tool capsule chambers, the wafer is transferred to a plating chamber where the optimizer is then used to select a plating recipe that will yield a uniform bulk film, at the desired thickness, based on the nominal seed layer thickness. After the bulk film plating process has completed, the wafer is transferred to a capsule cleaning chamber, whereupon it is removed from the tool.

As an additional sample process, a wafer is brought to the plating tool and placed in the on-board metrology station to determine the thickness profile of the CVD-deposited seed layer. The wafer is then transferred to a plating chamber. Using the seed layer measurements from the on-board metrology station, the optimizer is used to select a plating recipe that will yield a convex (center-thick) bulk film, at the desired nominal thickness. After the plating process has completed, the wafer is transferred to a capsule cleaning chamber, whereupon it is removed from the tool.

As an additional sample process, a wafer comes to an electroplating tool with a seed layer, applied using physical vapor deposition, that is non-uniform. A metrology station is used to measure the non-uniformity, and the optimizer operates the multiple-electrode reactor to correct the measured non-uniformity. Seed layer repair is then performed using an electroless ion plating process to produce a final, more uniform, seed layer. The optimizer then operates to deposit bulk metal onto the repaired seed layer.

As an additional sample process, a semiconductor fabricator has two physical vapor deposition tools ("PVD tools"), each of which has its own particular characteristics. A wafer processed by the first PVD tool and having a seed layer non-uniformity is directed to a first multiple-electrode reactor for seed layer repair. A wafer from the second PVD tool that has a different seed layer non-uniformity is directed to a second multiple-electrode reactor for seed layer repair. Bulk metal is then deposited onto the repaired seed layers of the two wafers in a third CFD reactor under the control of the optimizer.

Additional applications of the optimizer include:

Single plating example: The production environment can involve many recipes on a tool because each wafer may require multiple processing steps. For example, there may be 5–7 metal interconnect layers and each of the layers have different process parameters. Furthermore, a tool may be processing several different products. The advantage having a multiple anode reactor on the tool (like the CFD reactor) is that unique anode currents and optimal performance may be specified for all the different recipes on all the different chambers on the tool.

A basic application of the optimizer is to aid in the initial dial-in process for all of the recipes that are going to be run on a tool in production. In this mode, recipes will be written and tested experimentally prior to production, using the optimizer as an aid to obtained uniformity specifications. In this picture of workpiece production, the optimizer is used during the set-up phase only, saving the process engineer much time in setting up the tool and each of the recipes. If seed-layers coming into the tool are identical and stable, the above picture is sufficient.

If the seed-layers are not consistent, then off-tool metrology or integrated metrology can be used to monitor the changes in the seed-layers and the optimizer can be used to modify the anode currents in the recipe to compensate for these variations.

ECD seed followed by bulk ECD: In the case of sequential plating steps, metrology before and after each plating step allows for recipe current adjustments with the optimizer to each process. In the case of ECD seed, the initial PVD or CVD layer of metal can be measured and adjusted for using the feed-forward feature of the optimizer. Note: In this process the resistance of the barrier layer under the seed layer can also have a large influence on the plating uniformity, if the resistance of this layer can be measured, then the optimizer can be used to compensate for this effect (it may take more than one iteration of the optimizer).

Dial-In Uniform Current Density Recipes:

Using the optimizer and metrology the optimizer can be used to help dial in recipes that insure uniform current density during the feature filling step.

Table Look-Up:

The optimal currents to plate uniformly on different thickness seed-layers (assuming the seed layers are substantially uniform) can be determined in advance, using the optimizer to find these currents. Then the currents can be pulled from a table, when the resistivity of the seed layer is measured. This may be quite useful for platen plating (solder) where the seed layer resistance is constant for the whole plating run.

The optimizer may be used to control process parameters for a wide variety of types and designs of microelectronic workpiece processing devices. Various illustrative examples of such devices are discussed below.

Figure 8:
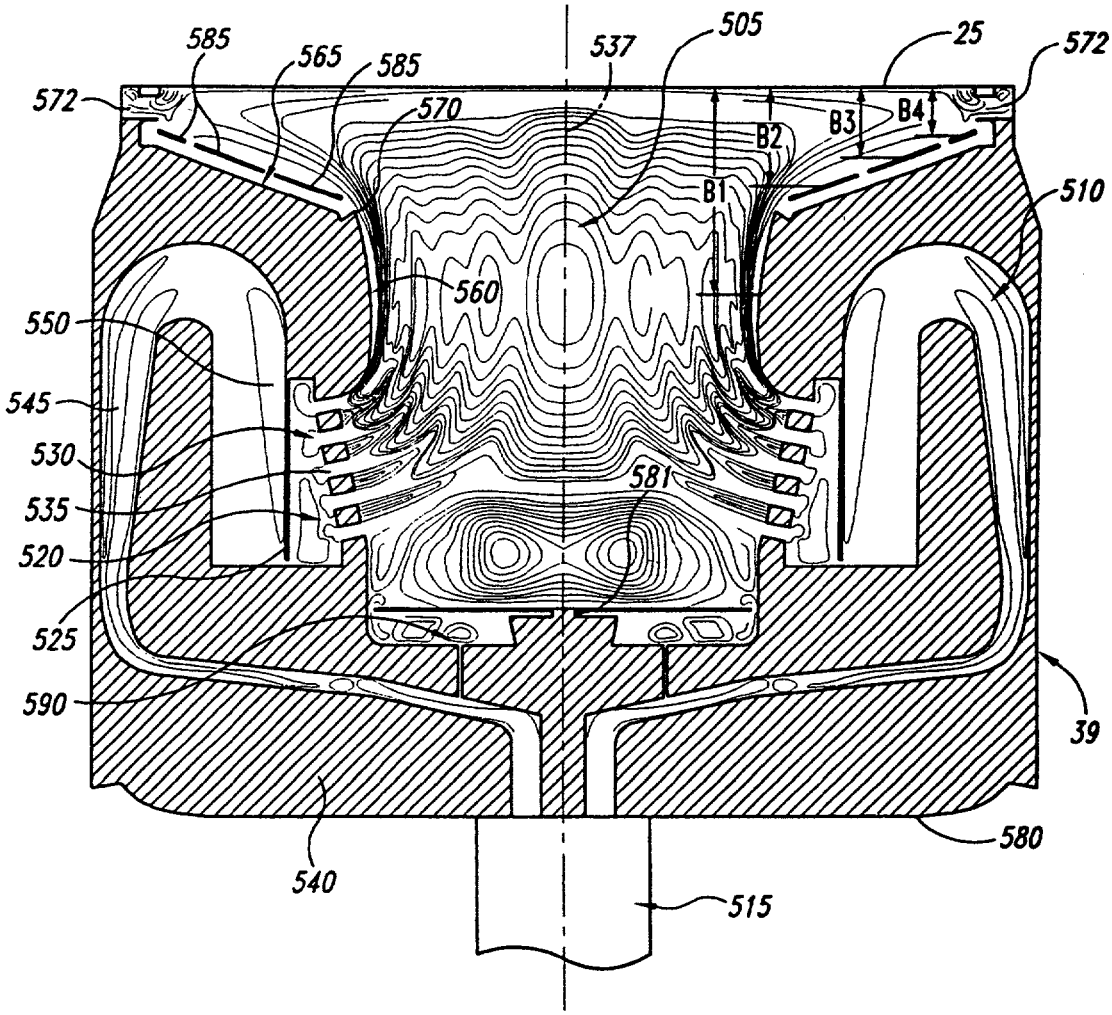
FIG. 8 is a schematic diagram of one embodiment of a process container that may be used in the reactor assembly shown in FIG. 3, and includes an illustration of the velocity flow profiles associated with the flow of the processing fluid through the reactor chamber.

FIG. 8 illustrates the basic construction of one embodiment of interior processing container 39, including a plurality of individually controlled electrodes. It also illustrates the corresponding flow velocity contour pattern resulting from the processing container construction. As shown, the processing container 39 generally comprises a main fluid flow chamber 505, an antechamber 510, a fluid inlet 515, a plenum 520, a flow diffuser 525 separating the plenum 520 from the antechamber 510, and a nozzle/slot assembly 530 separating the plenum 520 from the main chamber 505. These components cooperate to provide a flow of electrochemical processing fluid (here, of the electroplating solution) at the microelectronic workpiece 25 that has a substantially radially independent normal component. In the illustrated embodiment, the impinging flow is centered about central axis 537 and possesses a nearly uniform component normal to the surface of the microelectronic workpiece 25. This results in a substantially uniform mass flux to the microelectronic workpiece surface that, in turn, enables substantially uniform processing thereof.

Notably, this desirable flow characteristic is achieved without the use of a diffuser disposed between the electrodes/anode(s) and surface of the microelectronic workpiece that is to be electrochemically processed (e.g., electroplated). As such, the anodes used in the electroplating reactor can be placed in close proximity to the surface of the microelectronic workpiece to thereby provide substantial control over local electrical field/current density parameters used in the electroplating process. This substantial degree of control over the electrical parameters allows the reactor to be readily adapted to meet a wide range of electroplating requirements (e.g., seed layer thickness, seed layer type, electroplated material, etc.) without a corresponding change in the reactor hardware. Rather, adaptations can be implemented by altering the electrical parameters used in the electroplating process through, for example, software control of the power provided to the anodes.

The reactor design thus effectively de-couples the fluid flow from adjustments to the electric field. An advantage of this approach is that a chamber with nearly ideal flow for electroplating and other electrochemical processes (i.e., a design which provides a substantially uniform diffusion layer across the microelectronic workpiece) may be designed that will not be degraded when electroplating or other electrochemical process applications require significant changes to the electric field.

The processing container 39, as noted above, is provided with a plurality of individually controlled electrodes (referenced hereinafter, without limitation, as "anodes"). In the illustrated embodiment, a principal anode 580 is disposed in the lower portion of the main chamber 505. If the peripheral edges of the surface of the microelectronic workpiece 25 extends radially beyond the extent of contoured sidewall 560, then the peripheral edges are electrically shielded from principal anode 580 and reduced plating will take place in those regions. As such, a plurality of annular anodes 585 are disposed in a generally concentric manner on slanted sidewall 565 to provide a flow of electroplating current to the peripheral regions.

Anodes 580 and 585 of the illustrated embodiment are disposed at different distances from the surface of the microelectronic workpiece 25 that is being electroplated. More particularly, the anodes 580 and 585 are concentrically disposed in different horizontal planes. Such a concentric arrangement combined with the vertical differences allow the anodes 580 and 585 to be effectively placed close to the surface of the microelectronic workpiece 25 without generating a corresponding adverse impact on the flow pattern as tailored by nozzles 535.

The effect and degree of control that an anode has on the electroplating of microelectronic workpiece 25 is dependent on the effective distance between that anode and the surface of the microelectronic workpiece that is being electroplated. More particularly, all other things being equal, an anode that is effectively spaced a given distance from the surface of microelectronic workpiece 25 will have an impact on a larger area of the microelectronic workpiece surface than an anode that is effectively spaced from the surface of microelectronic workpiece 25 by a lesser amount. Anodes that are effectively spaced at a comparatively large distance from the surface of microelectronic workpiece 25 thus have less localized control over the electroplating process than do those that are spaced at a smaller distance. It is therefore desirable to effectively locate the anodes in close proximity to the surface of microelectronic workpiece 25 since this allows more versatile, localized control of the electroplating process. Advantage can be taken of this increased control to achieve greater uniformity of the resulting electroplated film. Such control is exercised, for example, by placing the electroplating power provided to the individual anodes under the control of a programmable controller or the like. Adjustments to the electroplating power can thus be made subject to software control based on manual or automated inputs.

In the illustrated embodiment, anode 580 is effectively "seen" by microelectronic workpiece 25 as being positioned a distance B1 from the surface of microelectronic workpiece 25. This is because the relationship between the anode 580 and sidewall 560 creates a virtual anode having an effective area defined by the innermost dimensions of sidewall 560. In contrast, anodes 585 are at effective distances B2, B3, and B4 proceeding from the innermost anode to the outermost anode, with the outermost anode being closest to the microelectronic workpiece 25. All of the anodes 585 in this embodiment are in close proximity (i.e., about 1 in. or less, with the outermost anode being spaced from the microelectronic workpiece by about 10 mm) to the surface of the microelectronic workpiece 25 that is being electroplated. Since anodes 585 are in close proximity to the surface of the microelectronic workpiece 25, they can be used to provide effective, localized control over the radial film growth at peripheral portions of the microelectronic workpiece. Such localized control is particularly desirable at the peripheral portions of the microelectronic workpiece since it is those portions that are more likely to have a high uniformity gradient (most often due to the fact that electrical contact is made with the seed layer of the microelectronic workpiece at the outermost peripheral regions resulting in higher plating rates at the periphery of the microelectronic workpiece compared to the central portions thereof).

The foregoing anode arrangement is particularly well-suited for plating microelectronic workpieces having highly resistive seed layers as well as for plating highly resistive materials on microelectronic workpieces. Generally stated, the more resistive the seed layer or material that is to be deposited, the more the magnitude of the current at the central anode 580 (or central anodes) should be increased to yield a uniform film.

FIGS. 9–12 illustrate a further embodiment of an improved reactor chamber. The embodiment illustrated in these figures retains the advantageous electric field and flow characteristics of the foregoing reactor construction while concurrently being useful for situations in which anode/electrode isolation is desirable. Such situations include, but are not limited to, the following:

- instances in which the electrochemical electroplating solution must pass over an electrode, such as an anode, at a high flow rate to be optimally effective;
- instances in which one or more gases evolving from the electrochemical reactions at the anode surface must be removed in order to insure uniform electrochemical processing; and
- instances in which consumable electrodes are used.

Figure 9:
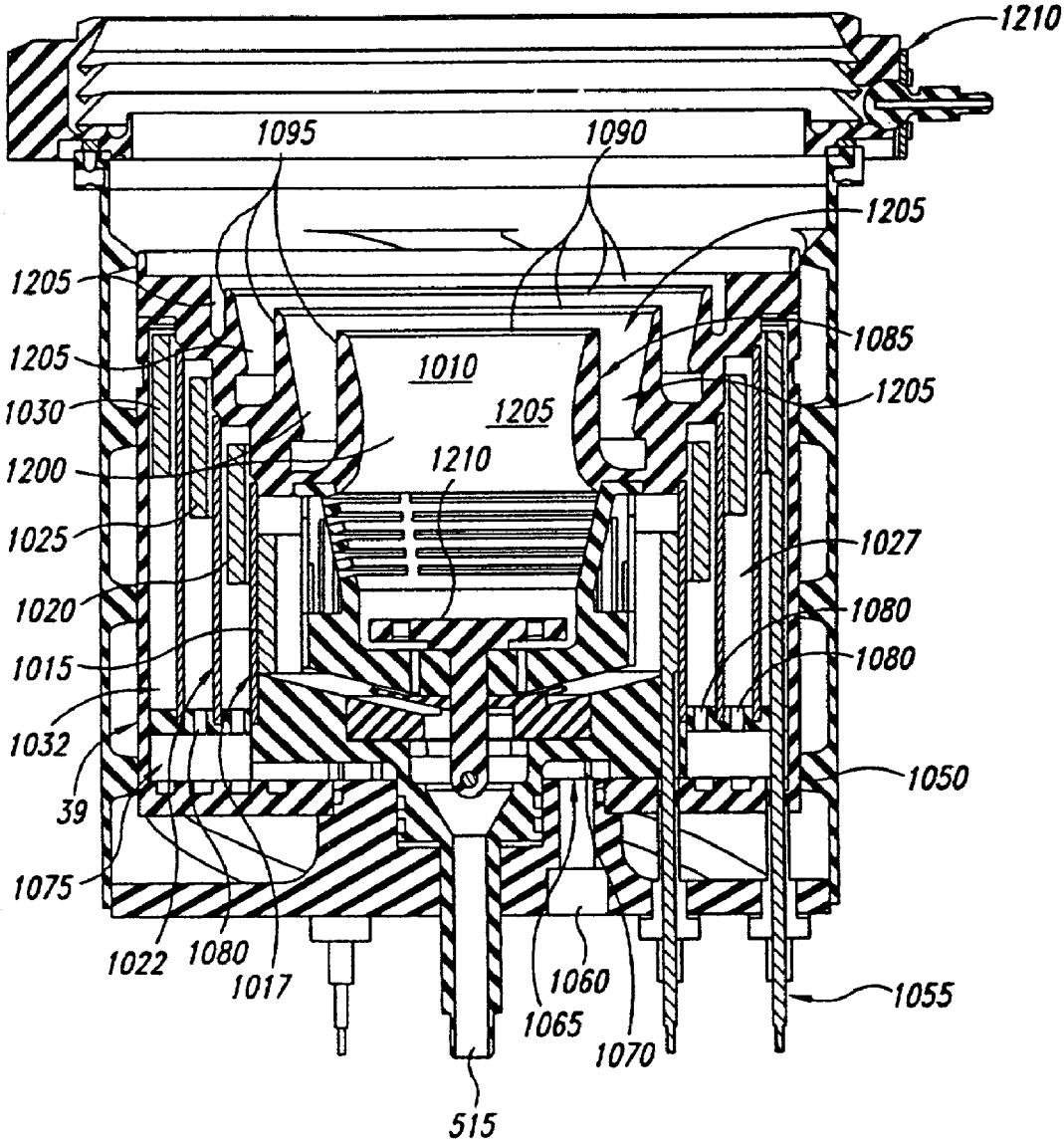
FIGS. 9 and 10 illustrate one embodiment of a complete processing chamber assembly that may be used in connection with the present invention.
Figure 10:
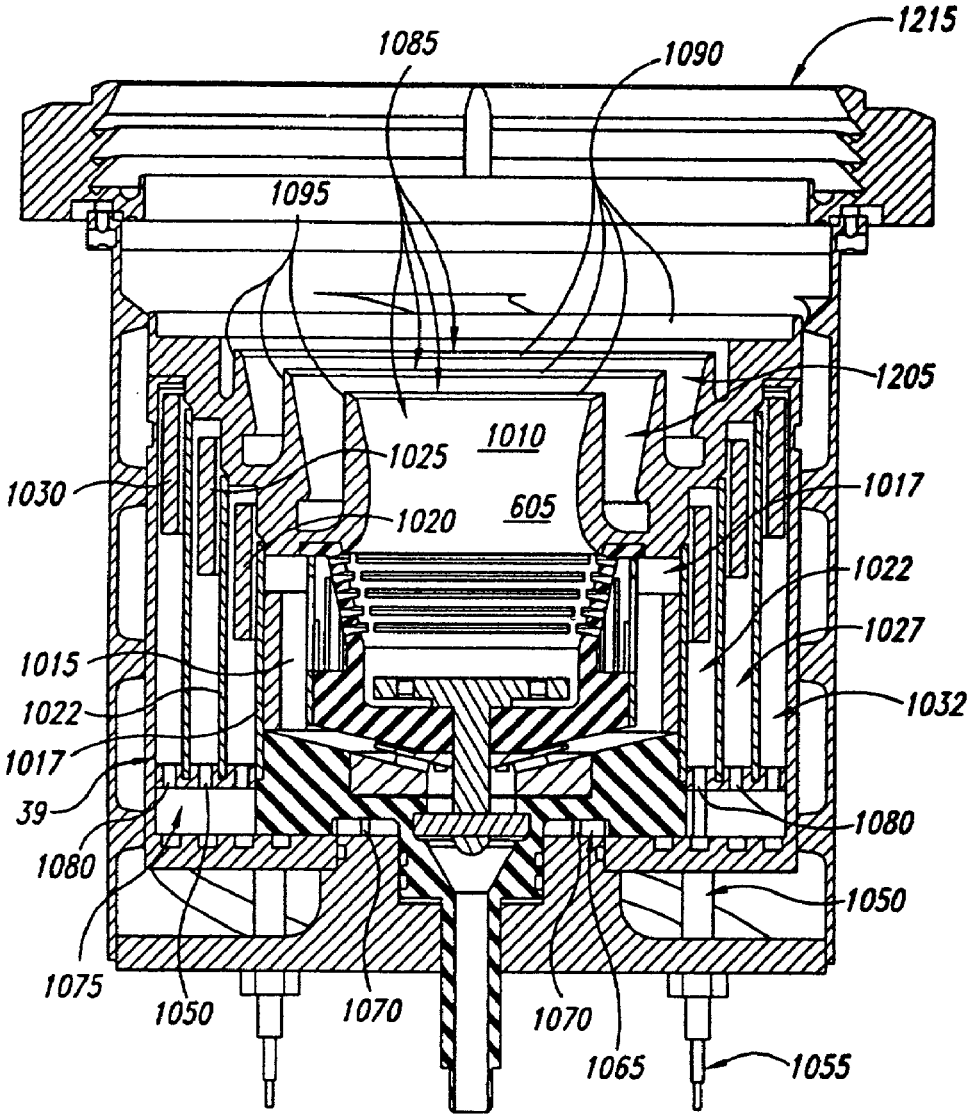

With reference to FIGS. 9 and 10, the reactor includes an electrochemical electroplating solution flow path into the innermost portion of the processing chamber that is very similar to the flow path of the embodiment illustrated in FIG. 4. As such, components that have similar functions are not further identified here for the sake of simplicity. Rather, only those portions of the reactor that significantly differ from the foregoing embodiment are identified and described below.

One significant distinction between the embodiments exists in connection with the anode electrodes and the appertaining structures and fluid flow paths. More particularly, the processing container 39 includes a plurality of ring-shaped anodes 1015, 1020, 1025 and 1030 that are concentrically disposed with respect to one another in respective anode chamber housings 1017, 1022, 1027 and 1032. As shown, each anode 1015, 1020, 1025 and 1030 has a vertically oriented surface area that is greater than the surface area of the corresponding anodes shown in the foregoing embodiments. Four such anodes are employed in the disclosed embodiment, but a larger or smaller number of anodes may be used depending upon the electrochemical processing parameters and results that are desired. Each anode 1015, 1020, 1025 and 1030 is supported in the respective anode chamber housing 1017, 1022, 1027 and 1032 by at least one corresponding support/conductive member 1050 that extends through the bottom of the processing base 37 and terminates at an electrical connector 1055 for connection to an electrical power source.

In accordance with the disclosed embodiment, fluid flow to and through the three outer most chamber housings 1022, 1027 and 1032 is provided from an inlet 1060 that is separate from inlet 515, which supplies the fluid flow through an innermost chamber housing 1017. As shown, fluid inlet 515 provides electroplating solution to a manifold 1065 having a plurality of slots 1070 disposed in its exterior wall. Slots 1070 are in fluid communication with a plenum 1075 that includes a plurality of openings 1080 through which the electroplating solution respectively enters the three anode chamber housings 1022, 1027 and 1032. Fluid entering the anode chamber housings 1017, 1022, 1027 and 1032 flows over at least one vertical surface and, preferably, both vertical surfaces of the respective anode 1015, 1020, 1025 and 1030.

Each anode chamber housing 1017, 1022, 1027 and 1032 includes an upper outlet region that opens to a respective cup 1085. Cups 1085, as illustrated, are disposed in the reactor chamber so that they are concentric with one another. Each cup includes an upper rim 1090 that terminates at a predetermined height with respect to the other rims, with the rim of each cup terminating at a height that is vertically below the immediately adjacent outer concentric cup. Each of the three innermost cups further includes a substantially vertical exterior wall 1095 and a slanted interior wall 1200. This wall construction creates a flow region 1205 in the interstitial region between concentrically disposed cups (excepting the innermost cup that has a contoured interior wall that defines the fluid flow region 1205 and than the outer most flow region 1205 associated with the outer most anode) that increases in area as the fluid flows upward toward the surface of the microelectronic workpiece under process. The increase in area effectively reduces the fluid flow velocity along the vertical fluid flow path, with the velocity being greater at a lower portion of the flow region 1205 when compared to the velocity of the fluid flow at the upper portion of the particular flow region.

The interstitial region between the rims of concentrically adjacent cups effectively defines the size and shape of each of a plurality of virtual anodes, each virtual anode being respectively associated with a corresponding anode disposed in its respective anode chamber housing. The size and shape of each virtual anode that is seen by the microelectronic workpiece under process is generally independent of the size and shape of the corresponding actual anode. As such, consumable anodes that vary in size and shape over time as they are used can be employed for anodes 1015, 1020, 1025 and 1030 without a corresponding change in the overall anode configuration is seen by the microelectronic workpiece under process. Further, given the deceleration experienced by the fluid flow as it proceeds vertically through flow regions 1205, a high fluid flow velocity may be introduced across the vertical surfaces of the anodes 1015, 1020, 1025 and 1030 in the anode chamber housings 1022, 1027 and 1032 while concurrently producing a very uniform fluid flow pattern radially across the surface of the microelectronic workpiece under process. Such a high fluid flow velocity across the vertical surfaces of the anodes 1015, 1020, 1025 and 1030, as noted above, is desirable when using certain electrochemical electroplating solutions, such as electroplating fluids available from Atotech. Further, such high fluid flow velocities may be used to assist in removing some of the gas bubbles that form at the surface of the anodes, particularly inert anodes. To this end, each of the anode chamber housings 1017, 1022, 1027 and 1032 may be provided with one or more gas outlets (not illustrated) at the upper portion thereof to vent such gases.

Of further note, unlike the foregoing embodiment, element 1210 is a securement that is formed from a dielectric material. The securement 1210 is used to clamp a plurality of the structures forming reactor base 35 together. Although securement 1210 may be formed from a conductive material so that it may function as an anode, the innermost anode seen by the microelectronic workpiece under process is preferably a virtual anode corresponding to the interior most anode 1015.

Figure 11:
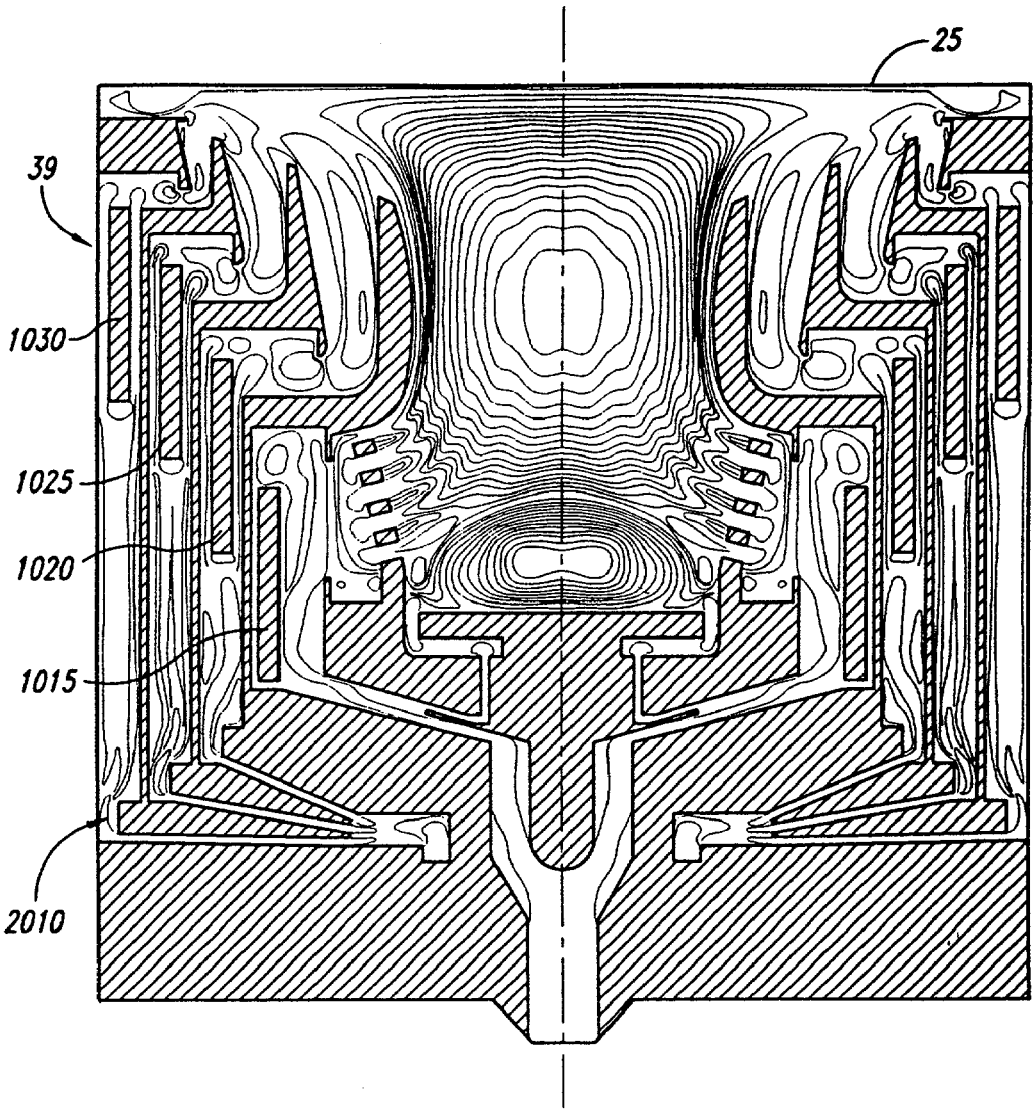
FIGS. 11 and 12 are cross-sectional views of computer-generated velocity flow contours of the processing chamber embodiment of FIGS. 9 and 10.
Figure 12:
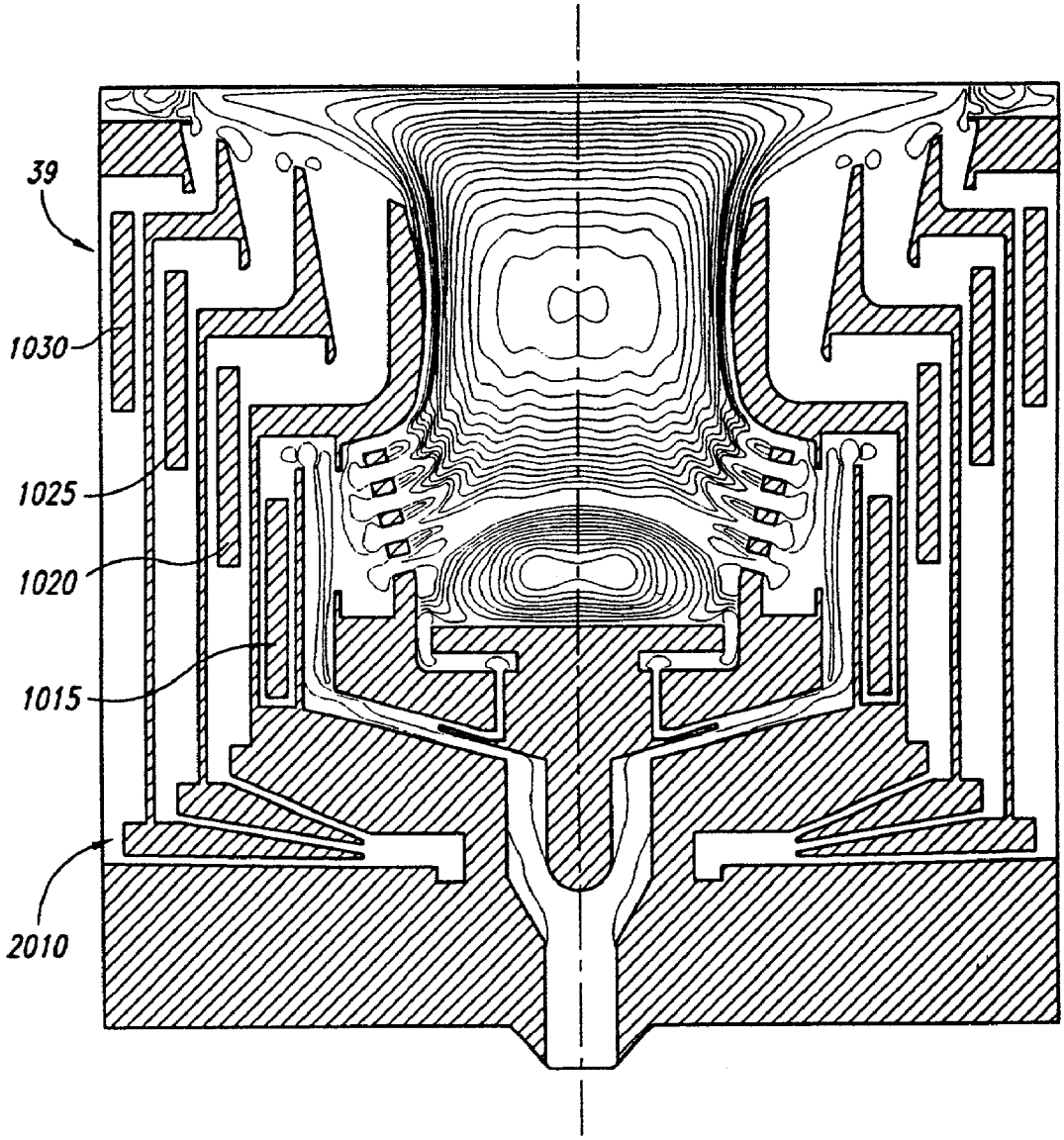
Figure 13:
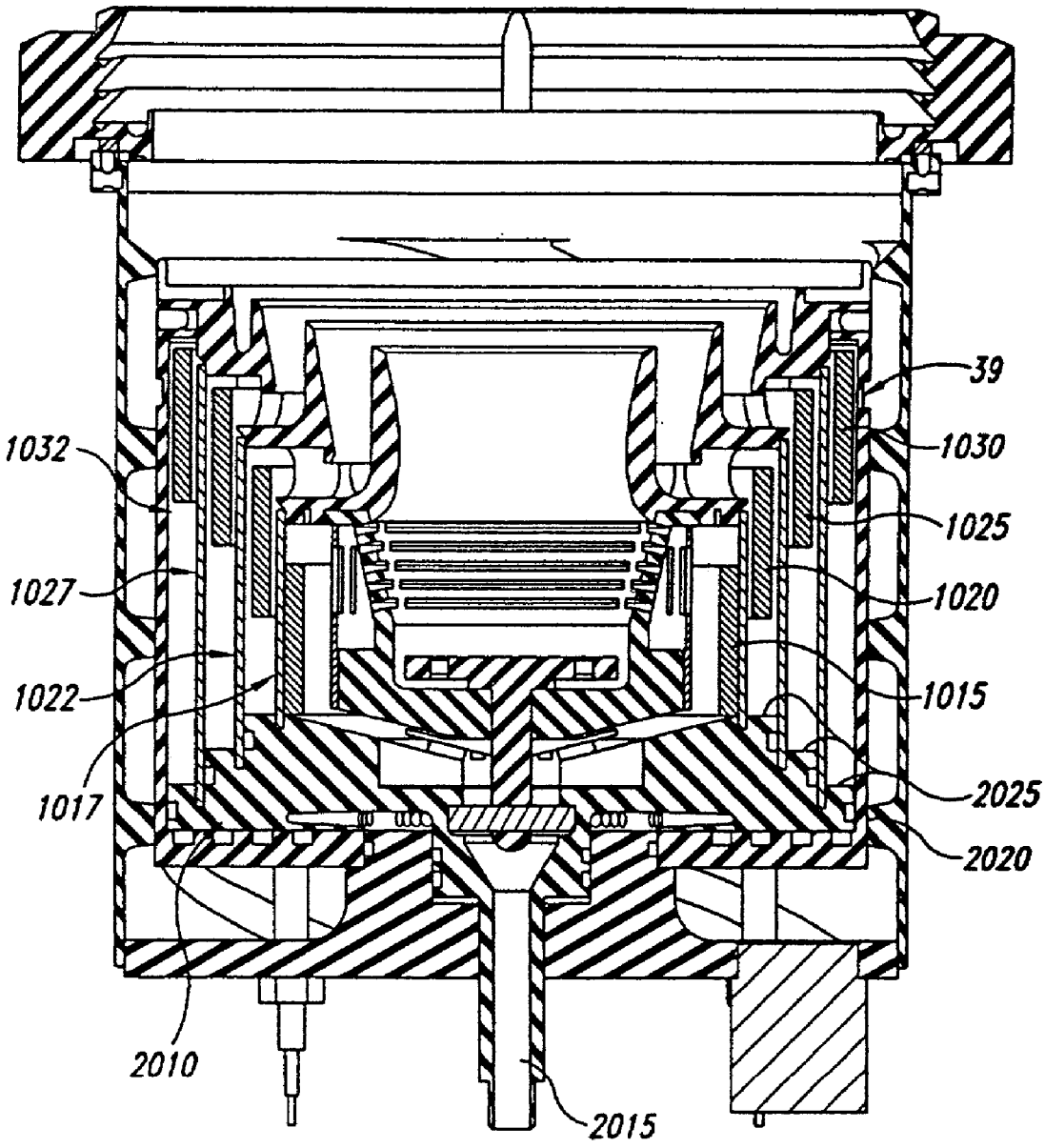
FIGS. 13 and 14 illustrate a modified version of the processing chamber of FIGS. 9 and 10.
Figure 14:
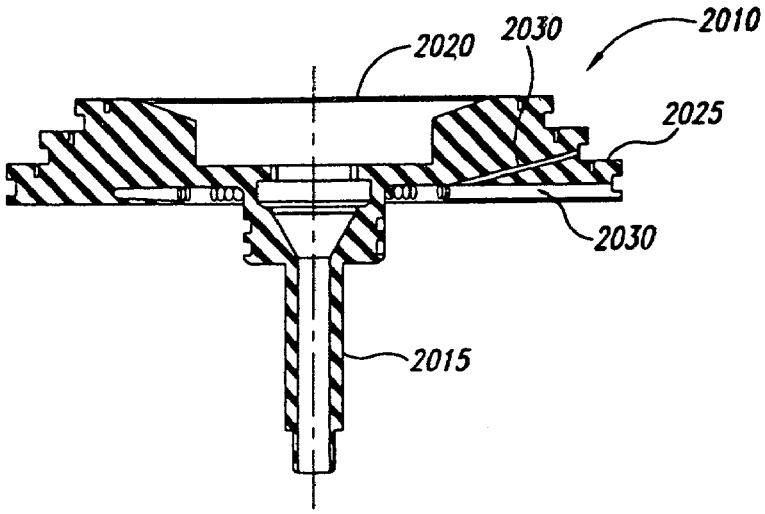
Figure 15:
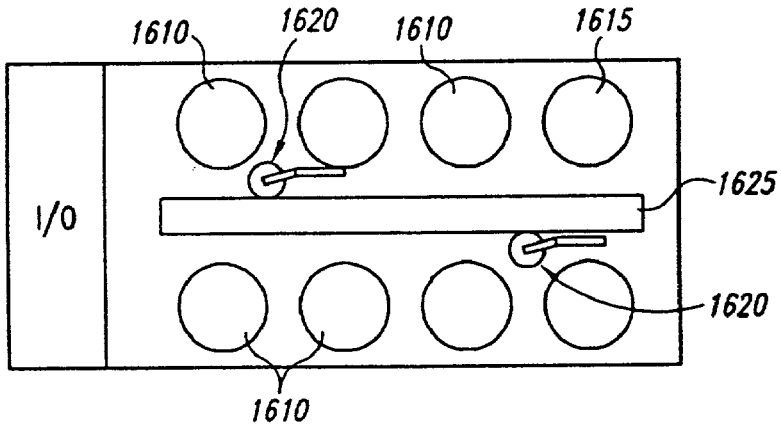
FIGS. 15 and 16 illustrate two embodiments of processing tools that may incorporate one or more processing stations that are constructed and operate in accordance with the teachings of the present invention.

FIGS. 11 and 12 illustrate computer simulations of fluid flow velocity contours of a reactor constructed in accordance with the embodiment shown in FIGS. 13 through 15. In this embodiment, all of the anodes of the reactor base may be isolated from a flow of fluid through the anode chamber housings. To this end, FIG. 11 illustrates the fluid flow velocity contours that occur when a flow of electroplating solution is provided through each of the anode chamber housings, while FIG. 12 illustrates the fluid flow velocity contours that occur when there is no flow of electroplating solution provided through the anode chamber housings past the anodes. This latter condition can be accomplished in the reactor of by turning off the flow the flow from the second fluid flow inlet (described below) and may likewise be accomplished in the reactor of FIGS. 9 and 10 by turning of the fluid flow through inlet 1060. Such a condition may be desirable in those instances in which a flow of electroplating solution across the surface of the anodes is found to significantly reduce the organic additive concentration of the solution.

FIG. 13 illustrates a variation of the reactor embodiment shown in FIG. 10. For the sake of simplicity, only the elements pertinent to the following discussion are provided with reference numerals. This further embodiment employs a different structure for providing fluid flow to the anodes 1015, 1020, 1025 and 1030. More particularly, the further embodiment employs an inlet member 2010 that serves as an inlet for the supply and distribution of the processing fluid to the anode chamber housings 1017, 1022, 1027 and 1032.

With reference to FIGS. 13 and 14, the inlet member 2010 includes a hollow stem 2015 that may be used to provide a flow of electroplating fluid. The hollow stem 2015 terminates at a stepped hub 2020. Stepped hub 2020 includes a plurality of steps 2025 that each include a groove dimensioned to receive and support a corresponding wall of the anode chamber housings. Processing fluid is directed into the anode chamber housings through a plurality of channels 2030 that proceed from a manifold area into the respective anode chamber housing.

This latter inlet arrangement assists in further electrically isolating anodes 1015, 1020, 1025 and 1030 from one another. Such electrical isolation occurs due to the increased resistance of the electrical flow path between the anodes. The increased resistance is a direct result of the increased length of the fluid flow paths that exist between the anode chamber housings.

The manner in which the electroplating power is supplied to the microelectronic workpiece at the peripheral edge thereof affects the overall film quality of the deposited metal. Some of the more desirable characteristics of a contact assembly used to provide such electroplating power include, for example, the following:

- uniform distribution of electroplating power about the periphery of the microelectronic workpiece to maximize the uniformity of the deposited film;
- consistent contact characteristics to insure wafer-to-wafer uniformity;
- minimal intrusion of the contact assembly on the microelectronic workpiece periphery to maximize the available area for device production; and
- minimal plating on the barrier layer about the microelectronic workpiece periphery to inhibit peeling and/or flaking.

To meet one or more of the foregoing characteristics, reactor assembly 20 preferably employs a contact assembly that includes the contacts 85 shown in FIG. 3. The contact assembly may be designed to provide either a continuous electrical contact or a high number of discrete electrical contacts with the microelectronic workpiece 25. By providing a more continuous contact with the outer peripheral edges of the microelectronic workpiece 25, in this case around the outer circumference of the semiconductor wafer, a uniform current is supplied to the microelectronic workpiece 25 that promotes uniform current densities. The uniform current densities enhance uniformity in the depth of the deposited material.

The contact assembly may include contact members that provide minimal intrusion about the microelectronic workpiece periphery while concurrently providing consistent contact with the seed layer. Contact with the seed layer is enhanced by using a contact member structure that provides a wiping action against the seed layer as the microelectronic workpiece is brought into engagement with the contact assembly. This wiping action assists in removing any oxides at the seed layer surface thereby enhancing the electrical contact between the contact structure and the seed layer. As a result, uniformity of the current densities about the microelectronic workpiece periphery is increased and the resulting film is more uniform. Further, such consistency in the electrical contact facilitates greater consistency in the electroplating process from wafer-to-wafer thereby increasing wafer-to-wafer uniformity.

The contact assembly may also include one or more structures that provide a barrier, individually or in cooperation with other structures, that separates the contact/contacts 85, the peripheral edge portions and backside of the microelectronic workpiece 25 from the plating solution. This prevents the plating of metal onto the individual contacts and, further, assists in preventing any exposed portions of the barrier layer near the edge of the microelectronic workpiece 25 from being exposed to the electroplating environment. As a result, plating of the barrier layer and the appertaining potential for contamination due to flaking of any loosely adhered electroplated material is substantially limited. Exemplary contact assemblies suitable for use in the present system are illustrated in U.S. Ser. No. 09/113,723, while Jul. 10, 1998, entitled "PLATING APPARATUS WITH PLATING CONTACT WITH PERIPHERAL SEAL MEMBER", which is hereby incorporated by reference.

Figure 16:
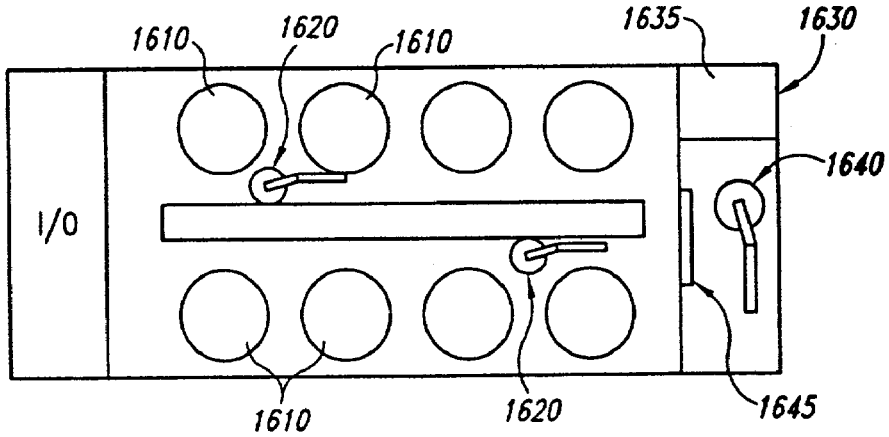

One or more of the foregoing reactor assembly's may be readily integrated in a processing tool that is capable of executing a plurality of processes on a workpiece, such as a semiconductor microelectronic workpiece. One such processing tool is the LT-210™ electroplating apparatus available from Semitool, Inc., of Kalispell, Mont. FIGS. 15 and 16 illustrate such integration.

The system of FIG. 15 includes a plurality of processing stations 1610. Preferably, these processing stations include one or more rinsing/drying stations and one or more electroplating stations (including one or more electroplating reactors such as the one above), although further immersion-chemical processing stations constructed in accordance with the present invention may also be employed. The system also preferably includes a thermal processing station, such as at 1615, that includes at least one thermal reactor that is adapted for rapid thermal processing (RTP).

The workpieces are transferred between the processing stations 1610 and the RTP station 1615 using one or more robotic transfer mechanisms 1620 that are disposed for linear movement along a central track 1625. One or more of the stations 1610 may also incorporate structures that are adapted for executing an in-situ rinse. Preferably, all of the processing stations as well as the robotic transfer mechanisms are disposed in a cabinet that is provided with filtered air at a positive pressure to thereby limit airborne contaminants that may reduce the effectiveness of the microelectronic workpiece processing.

FIG. 16 illustrates a further embodiment of a processing tool in which an RTP station 1635, located in portion 1630, that includes at least one thermal reactor, may be integrated in a tool set. Unlike the embodiment of FIG. 15, at least one thermal reactor is serviced by a dedicated robotic mechanism 1640. The dedicated robotic mechanism 1640 accepts workpieces that are transferred to it by the robotic transfer mechanisms 1620. Transfer may take place through an intermediate staging door/area 1645. As such, it becomes possible to hygienically separate the RTP portion 1630 of the processing tool from other portions of the tool. Additionally, using such a construction, the illustrated annealing station may be implemented as a separate module that is attached to upgrade an existing tool set. It will be recognized that other types of processing stations may be located in portion 1630 in addition to or instead of RTP station 1635.

It is envisioned that the optimizer may be used in one or more stages of widely-varying processes for processing semiconductor workpieces. It is further envisioned that the optimizer may operate completely separately from the processing tools performing such processes, with only some mechanism for the optimizer to pass control parameters to such processing tools. Indeed, the optimizer and processing tools may be operated under the control and/or ownership of different parties, and/or in different physical locations.

Numerous modifications may be made to the described optimizer without departing from the basic teachings thereof. For example, although the present invention is described in the context of electrochemical processing of the microelectronic workpiece, the teachings herein can also be extended to other types of microelectronic workpiece processing, including various kinds of material deposition processes. For example, the optimizer may be used to control electrophoretic deposition of material, such as positive or negative electrophoretic photoresists or electrophoretic paints; chemical or physical vapor deposition; etc. In effect, the teachings herein can be extended to other microelectronic workpiece processing systems that have individually controlled processing elements that are responsive to control parameters and that have interdependent effects on a physical characteristic of the microelectronic workpiece that is processed using the elements. Such systems may employ sensitivity tables or matrices as set forth herein and use them in calculations with one or more input parameters sets to arrive at control parameter values that accurately result in the targeted physical characteristic of the microelectronic workpiece. Although the present invention has been described in substantial detail with reference to one or more specific embodiments, those of skill in the art will recognize that changes may be made thereto without departing from the scope and spirit of the invention as set forth herein.

We claim:

1. A system for electrochemically processing a microelectronic workpiece comprising:

a principal fluid flow chamber;

a plurality of concentric anodes disposed in the principal fluid flow chamber, the concentric anodes being independently coupled to a power supply; and a controller operatively coupled to the concentric anodes, the controller having a computer operable medium including instructions that cause unique electric currents to be applied concurrently to a plurality of different concentric anodes such that a net positive current is provided to each anode so as to concurrently plate across the entire surface of the workpiece during a first stage of initially electrochemically processing the workpiece and form a final film having a non-uniform profile from a center of the workpiece to a perimeter.

2. The system of claim 1 wherein the controller is configured to receive an input parameter, and the instructions of the computer operable medium compute a set of electrical currents for the plurality of anodes that chance the distribution of material plated onto selected regions of the workpiece to achieve a target profile for a plated layer.

3. The system of claim 2 wherein final film has a convex surface.

4. The system of claim 1, further comprising a plurality of dielectric anode compartments having lateral projections at an upper end of the compartments, the concentric anodes being housed in corresponding compartments, and the lateral projections shielding the workpiece from the concentric anodes to define a plurality of concentric virtual anodes.

5. The system of claim 4 wherein the at least one conductive anode element is formed from an inert material.

6. The system of claim 1, further comprising a virtual anode including:

an anode chamber housing having a processing fluid inlet and a processing fluid outlet, the processing fluid outlet being disposed in close proximity to the microelectronic workpiece under process; and at least one conductive anode element disposed in the anode chamber housing.

7. The system of claim 1 and further comprising a plurality of nozzles disposed to provide a flow of the electrochemical processing fluid to the principal fluid flow chamber, the plurality of nozzles being arranged and directed to provide vertical and radial fluid flow components that combine to generate a substantially uniform normal flow component radially across the at least one surface of the workpiece.

8. The system of claim 1 wherein the principal fluid flow chamber is defined at an upper portion thereof by an angled wall, the angled wall supporting one or more of the plurality of concentric anodes.

9. The system of claim 1 wherein the principal fluid flow chamber further comprises an inlet disposed at a lower portion thereof that is configured to provide a Venturi effect that facilitates recirculation of processing fluid flow in a lower portion of the principal fluid flow chamber.

10. The system of claim 1 wherein the controller further comprises a current optimization subsystem for selecting the currents delivered through the concentric anodes by the controller.

11. The system of claim 10, further comprising a memory containing a Jacobian sensitivity matrix reflecting characteristics of the principal fluid flow chamber used by the current optimization subsystem in selecting the currents delivered through the concentric anodes by the controller.

12. The system of claim 1, further comprising a pump for circulating processing fluid within the principal flow chamber.

13. The system of claim 1 wherein the fluid flow chamber is adapted to contain an electrolyte solution for electroplating the microelectronic workpiece.

14. The system of claim 13 wherein the current delivered by the controller to each anode is selected to produce a more uniform layer of electroplated material on the microelectronic workpiece under process than was produced on an earlier-processed microelectronic workpiece.

15. A reactor for electrochemically processing a microelectronic workpiece comprising:

a principal fluid flow chamber;

a plurality of electrodes disposed in the principal fluid flow chamber;

a workpiece holder positioned to hold at least one surface of the microelectronic workpiece in contact with an electrochemical processing fluid in the principal fluid flow chamber at least during electrochemical processing of the microelectronic workpiece;

one or more electrical contacts configured to electrically contact the at least one surface of the microelectronic workpiece;

an electrical power supply connected to the one or more electrical contacts and to the plurality of electrodes, at least two of the plurality of electrodes being independently connected to the electrical power supply to facilitate independent supply of power thereto; and a control system connected to the electrical power supply to control at least one electrical power parameter respectively associated with each of the independently connected electrodes, the control system setting the at least one electrical power parameter for a given one of the independently connected electrodes based on one or more user input parameters and a plurality of predetermined sensitivity values, the predetermined sensitivity values corresponding to process perturbations resulting from perturbations of the electrical power parameter for the given one of the independently connected electrodes, and wherein the control system is configured to cause unique electric currents to be applied concurrently to a plurality of the different anodes such that a net positive current is provided to each anode so as to concurrently plate across the entire surface of the workpiece during a first stage of initially electrochemically processing the workpiece and form a final film having a non-uniform profile from a center of the workpiece to a perimeter.

16. A reactor as claimed in claim 15 wherein the at least one electrical parameter is electrical current.

17. A reactor as claimed in claim 15 wherein the sensitivity values are logically arranged within the control system as one or more Jacobian matrices.

18. A reactor as claimed in claim 15 wherein the at least one user input parameter comprises the thickness of a film that is to be electrochemically deposited on the at least one surface of the microelectronic workpiece.

19. A reactor as claimed in claim 15 wherein at least two of the independently connected electrodes are disposed at different effective distances from the surface of the microelectronic workpiece.

20. A reactor as claimed in claim 19 wherein the independently connected electrodes are arranged concentrically with respect to one another.

21. A reactor as claimed in claim 20 wherein the independently connected electrodes are arranged at increasing distances from the at least one surface of the microelectronic workpiece from an outermost one of the plurality of concentric anodes to an innermost one of the independently connected electrodes.

22. A reactor as claimed in claim 15 wherein the independently connected electrodes are arranged concentrically with respect to one another.

23. A reactor as claimed in claim 15 wherein the independently connected electrodes are disposed at the same effective distance from the at least one surface of the microelectronic workpiece.

24. A reactor as claimed in claim 23 wherein the independently connected electrodes are arranged concentrically with respect to one another.

25. A reactor as claimed in claim 15 wherein one or more of the independently connected electrodes is a virtual electrode.

26. A reactor as claimed in claim 25 wherein the virtual electrode comprises:

an electrode chamber housing having a processing fluid inlet and a processing fluid outlet, the processing fluid outlet being disposed in close proximity to the microelectronic workpiece under process;

at least one conductive electrode element disposed in the electrode chamber housing.

27. A processing container as claimed in claim 26 wherein the at least one conductive electrode element is formed from an inert material.

28. A processing container as claimed in claim 15 and further comprising a plurality of nozzles disposed to provide a flow of the electrochemical processing fluid to the principal fluid flow chamber, the plurality of nozzles being arranged and directed to provide vertical and radial fluid flow components that combine to generate a substantially uniform normal flow component radially across the at least one surface of the workpiece.

29. A reactor for immersion processing at least one surface of a microelectronic workpiece, the reactor comprising:

a reactor head including a workpiece support;

one or more electrical contacts disposed on the workpiece support and positioned thereon to make electrical contact with the microelectronic workpiece;

a processing container including a plurality of nozzles angularly disposed in a sidewall of a principal fluid flow chamber at a level within the principal fluid flow chamber below a surface of a bath of processing fluid normally contained therein during immersion processing;

a plurality of individually operable electrical conductors disposed in the principal fluid flow chamber and positioned for electrical contact with the processing fluid.

30. A reactor as claimed in claim 29 and further comprising an electrode disposed at a lower portion of the processing container to provide electrical contact between an electrical power supply and the processing fluid.

31. A reactor as claimed in claim 30 wherein the processing container is defined at an upper portion thereof by an angled wall, the processing container further comprising at least one further electrode in fixed positional alignment with the angled wall to provide electrical contact between an electrical power supply and the processing fluid.

32. A reactor as claimed in claim 29 and further comprising a motor connected to rotate the workpiece support and an associated microelectronic workpiece at least during processing of the at least one surface of the microelectronic workpiece.

* * * * *